US008739957B2

(12) United States Patent
Teramoto

(10) Patent No.: US 8,739,957 B2
(45) Date of Patent: Jun. 3, 2014

(54) ACCELERATION AND DECELERATION DEVICE AND ACCELERATION AND DECELERATION ESCALATOR INCLUDING THE SAME

(71) Applicant: Katsuya Teramoto, Numazu (JP)

(72) Inventor: Katsuya Teramoto, Numazu (JP)

( * ) Notice: Subject to any disclaimer, the term of this patent is extended or adjusted under 35 U.S.C. 154(b) by 12 days.

(21) Appl. No.: 13/859,735

(22) Filed: Apr. 10, 2013

(65) Prior Publication Data

US 2013/0220767 A1 Aug. 29, 2013

Related U.S. Application Data

(63) Continuation of application No. PCT/JP2010/072992, filed on Dec. 21, 2010.

(51) Int. Cl.
*B66B 23/12* (2006.01)
*B66B 21/12* (2006.01)

(52) U.S. Cl.
CPC ..... *B66B 21/12* (2013.01)
USPC ..... 198/334; 198/832.1

(58) Field of Classification Search
CPC ..... B66B 21/12
USPC ..... 198/334, 832, 832.1, 459.8, 461.1, 198/461.3
See application file for complete search history.

(56) References Cited

U.S. PATENT DOCUMENTS

| | | | | |
|---|---|---|---|---|
| 1,775,029 | A * | 9/1930 | Hippenmeyer | 198/832.1 |
| 1,793,498 | A * | 2/1931 | Maurice | 198/334 |
| 2,752,883 | A * | 7/1956 | Curtis | 198/459.8 |
| 2,986,263 | A * | 5/1961 | Jones | 198/459.8 |
| 3,590,741 | A * | 7/1971 | Zuppiger | 198/792 |
| 3,707,923 | A * | 1/1973 | Woodling | 198/334 |
| 3,842,961 | A * | 10/1974 | Burson | 198/334 |
| 3,874,297 | A * | 4/1975 | Kondo et al. | 198/334 |
| 4,284,191 | A * | 8/1981 | Lavau | 198/334 |
| 7,104,386 | B2 * | 9/2006 | Ogura et al. | 198/334 |
| 7,581,637 | B2 * | 9/2009 | Lenherr et al. | 198/459.8 |
| 2002/0060143 | A1 * | 5/2002 | Kilby et al. | 198/832 |
| 2007/0131523 | A1 * | 6/2007 | Nothum | 198/832 |

FOREIGN PATENT DOCUMENTS

| | | | |
|---|---|---|---|
| JP | 2587823 | B | 3/1997 |
| JP | H10-045362 | A | 2/1998 |
| JP | 2002-326780 | A | 11/2002 |

OTHER PUBLICATIONS

International Search Report for PCT/JP2010/072992 dated Mar. Jul. 26, 2011.

* cited by examiner

*Primary Examiner* — James R Bidwell
(74) *Attorney, Agent, or Firm* — Yokoi & Co., U.S.A., Inc.; Toshiyuki Yokoi

(57) ABSTRACT

An acceleration and deceleration device includes: a chain 19 that is endlessly guided along a predetermined first track; a U-shaped member 40 of which a terminal end portion is attached to the chain 19 so as to be swingable and a part from an intermediate portion to a front end portion is formed as two parallel members and which has a long and narrow U-shaped groove between the parallel members; and a subject moving body 102 that has a driving shaft sliding inside the U-shaped groove of the U-shaped member 40, wherein the driving shaft of the subject moving body 102 is rotatable with respect to the U-shaped member 40 within a predetermined range in the U-shaped groove of the U-shaped member 40 and the driving shaft of the subject moving body is slidable with respect to the U-shaped member in the U-shaped groove of the U-shaped member 40.

6 Claims, 14 Drawing Sheets

ACCELERATION AND DECELERATION DEVICE AND ACCELERATION AND DECELERATION ESCALATOR INCLUDING THE SAME

CROSS-REFERENCES TO RELATED APPLICATIONS

This application claims the benefit of priority and is a Continuation application of the prior International Patent Application No. PCT/JP2010/072992, with an international filing date of Dec. 21, 2010, which designated the United States, the entire disclosures of all applications are expressly incorporated by reference in their entirety herein.

BACKGROUND OF THE INVENTION

1. Field of the Invention

The present invention relates to an acceleration and deceleration device, and more particularly, to an acceleration and deceleration escalator of which the moving speed is slow at the platform and is able to be accelerated or decelerated at the intermediate portion.

2. Description of Related Art

In the existing escalator, the moving speed of a stair (a step) on which a person gets is constant and the maximum moving speed of the step is limited due to the slope. For this reason, the moving speed of the escalator is set to the generally allowed maximum speed, which has a problem in that accidents such as rollover of aged persons or children easily occur at the platform (the entrance and the exit) where a person gets.

Therefore, there is proposed an acceleration and deceleration escalator of which the moving speed at the platform is slow and is accelerated or decelerated at the intermediate portion (for example, see Patent Document 1).

[Patent Document 1]

Japanese Patent Application Laid-Open No. 2002-326780, "variable-speed escalator"

BRIEF SUMMARY OF THE INVENTION

The variable-speed escalator of Patent Document 1 is operated at a variable speed in a manner such that the interval between the respective pallets gradually changes due to the operation of the link mechanism in accordance with the advancing pallet. That is, the pallet driving chain of the variable-speed escalator also serves as a member forming a telescopic link, and is driven while being curved at the acceleration and deceleration portion. For this reason, there is concern that a high load may be applied to a peripheral component and the variable-speed escalator may be increased in size. Furthermore, since the link mechanism is provided throughout the entire length, the number of components increases. For this reason, there are problems in that the structure becomes complex, the maintenance cost is expensive, and the weight is heavy.

The invention is contrived to solve these problems. That is, it is an object of the invention to provide an acceleration and deceleration device capable of using respective components in a basically reasonable structure, improving the durability, simplifying the structure, reducing the maintenance cost, decreasing the number of components, and further decreasing the weight, and an acceleration and deceleration escalator including the same. Furthermore, it is an object of the invention to provide an acceleration and deceleration escalator of which the moving speed is slow at the platform and is accelerated or decelerated at the intermediate portion and which is able to be practically realized due to the simple structure and is applicable to a curved track.

According to the invention, there is provided an acceleration and deceleration device including: a chain that is endlessly guided along a predetermined first track; a U-shaped member of which a terminal end portion is attached to the chain so as to be swingable and a part from an intermediate portion to a front end portion is formed as two parallel members and which has a long and narrow U-shaped groove between the parallel members; and a subject moving body that has a driving shaft sliding inside the U-shaped groove of the U-shaped member, wherein the driving shaft of the subject moving body is rotatable with respect to the U-shaped member within a predetermined range in the U-shaped groove of the U-shaped member and the driving shaft of the subject moving body is slidable with respect to the U-shaped member in the U-shaped groove of the U-shaped member.

According to the embodiment of the invention, the acceleration and deceleration device further includes: a swing yoke that is provided so as to intersect with the U-shaped member; a skip rail that guides the swing yoke along a predetermined second track; and a travel support roller guiding rail that guides the driving shaft along a predetermined track, wherein the first track and the second track are different so that rotation angle of the U-shaped member can be changed when the U-shaped member is driven along the first track.

Furthermore, in the acceleration and deceleration device, the first track and the second track are formed so that the drive shaft guided by the travel support roller guiding rail is driven to slide in the U-shaped groove when the U-shaped member is moved along the first track while changing the rotation angle.

Furthermore, according to the invention, there is provided an acceleration and deceleration escalator including the acceleration and deceleration device, wherein the subject moving body is a pallet for an escalator, wherein the driving shaft is a pallet driving shaft, wherein while a slide roller provided in the pallet driving shaft is slidable in the U-shaped groove of the U-shaped member, and when the U-shaped member is driven along the chain, rotation angle of the U-shaped member is changed so that the slide roller is driven to slide in the U-shaped groove.

Furthermore, in the acceleration and deceleration escalator, the acceleration and deceleration device includes an acceleration chain driving device that accelerates the pallet of an acceleration portion from a first low speed to a high speed, and a deceleration chain driving device that decelerates the pallet of a deceleration portion from the high speed to a second low speed.

Furthermore, the acceleration and deceleration escalator further includes: a plurality of independent pallets that is continuously and endlessly arranged in a speed region which is sequentially divided into a first low-speed portion, an acceleration portion, a high-speed portion, a deceleration portion, and a second low-speed portion in the advancing direction from a lower step to an upper step; a guiding device that guides the respective pallets according to the arrangement; and a driving device that drives the respective pallets at a low speed or a high speed, wherein the respective pallets are driven at a predetermined first low speed in the first low-speed portion, are driven at the high speed in the high-speed portion, and are driven at the second low speed in the second low-speed portion.

Furthermore, in the acceleration and deceleration escalator, each pallet includes a horizontal footplate on which a person gets and an inclined plate which obliquely extends downward from the rear edge of the footplate in the advancing direction, each pallet includes a pallet driving shaft which is provided in the footplate and extends outward in the width direction, a travel support roller and a slide roller which are provided in the pallet driving shaft, and a posture roller which is provided in the inclined plate, the guiding device includes a travel support roller guiding device which guides the travel support roller according to the arrangement, a posture roller guiding device which guides the posture roller so as to horizontally maintain the upper surface of the footplate, and a pallet reversing device which turns each pallet at both end portions thereof in the advancing direction so that the pallet is reversed, and the driving device includes a first low-speed chain driving device which drives the pallet of the first low-speed portion at the first low speed, a high-speed chain driving device which drives the pallet of the high-speed portion at the high speed, and a second low-speed chain driving device which drives the pallet of the second low-speed portion at the second low speed.

According to the configuration of the invention, since the chain is mainly used without using a link, the respective components may be used in a basically reasonable structure, the structure is simple, the number of components is few, and the practicality is high. For this reason, the durability is high, the maintenance cost may be reduced, and the weight may be decreased.

Further, since the subject moving body is accelerated or decelerated according to a change in track or a change in position of the chain or the rail, a strong driving force may be obtained from the analogue acceleration or deceleration.

Furthermore, since each pallet is driven at a predetermined low speed in the low-speed portion, is driven at a high speed in the high-speed portion so as to be faster than the low speed, is accelerated in the acceleration portion from the low speed to the high speed, and is decelerated in the deceleration portion from the high speed to the low speed by the driving devices driven at every speed region, the moving speed may be made to be a low speed at the platform and be accelerated or decelerated at the intermediate portion.

Furthermore, since the driving device is driven at each speed region, the driving device may be practically realized due to the simple structure thereof.

DETAILED DESCRIPTION OF THE INVENTION

Hereinafter, exemplary embodiments of the invention will be described with reference to the drawings. Furthermore, in respective drawings, the repetitive description will not be repeated by giving the same reference signs to the common components.

Figure 1:
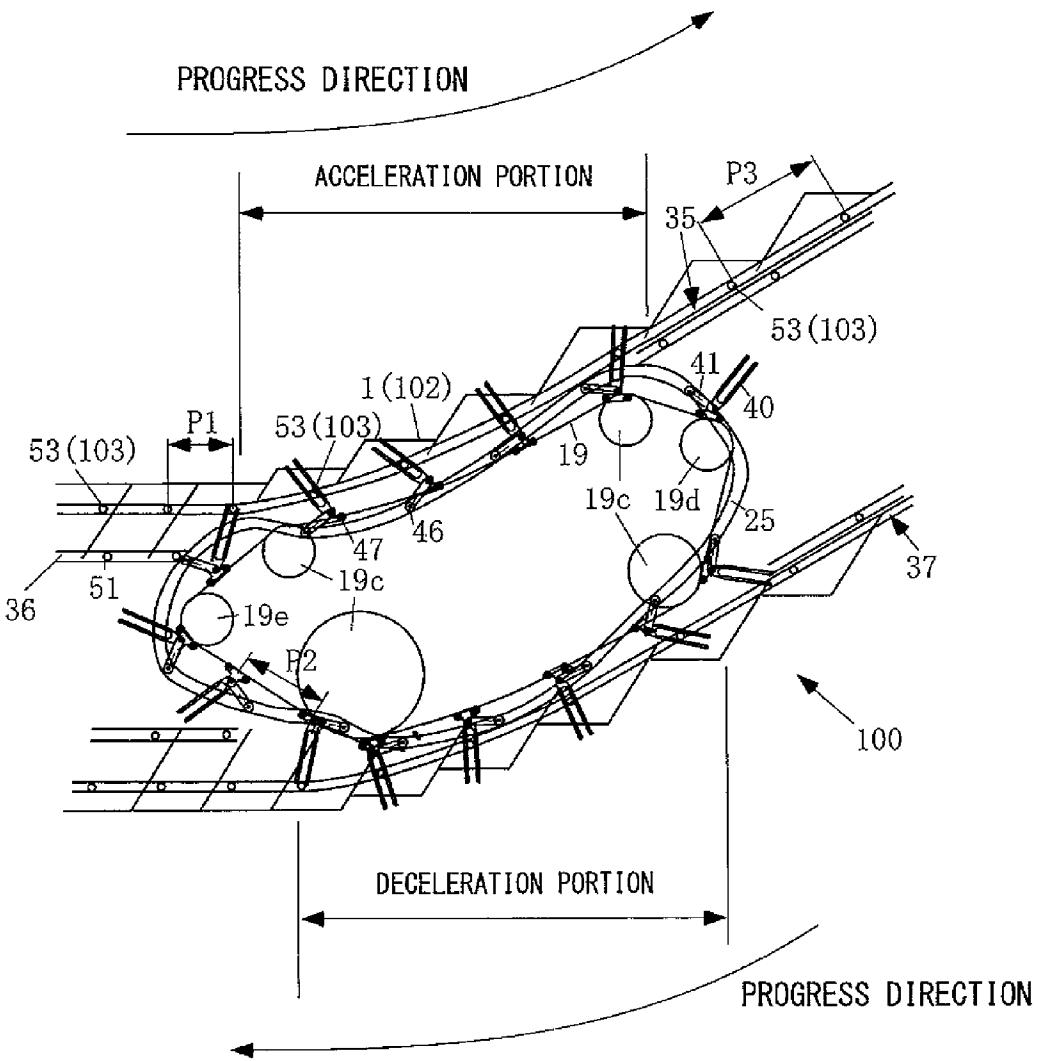
FIG. 1 is a side view illustrating an acceleration and deceleration device of a first embodiment.

An acceleration and deceleration device 100 of the invention will be described by referring to FIG. 1. FIG. 1 is a side view illustrating the acceleration and deceleration device 100 of the first embodiment of the invention.

The acceleration and deceleration device 100 of the invention includes: a chain 19 which is endlessly guided along a predetermined first track; a U-shaped member 40 of which a terminal end portion is attached to the chain 19 so as to be swingable and a part from the intermediate portion to the front end portion is formed of two parallel members and which has a long and narrow U-shaped groove between the parallel members; and a subject moving body 102 which has a driving shaft 103 sliding inside the U-shaped groove of the U-shaped member 40, and is a device which accelerates or decelerates the subject moving body 102 through a change in angle of the U-shaped member 40 with respect to the subject moving body 102 and a change in position of the driving shaft 103 inside the U-shaped groove of the U-shaped member 40.

That is, in the acceleration and deceleration device of the first embodiment shown in FIG. 1, the upper surface corresponds to the acceleration device, and the lower surface serves as the deceleration device. In other words, in the upper surface, the acceleration is performed when the subject moving body 102 moves from the left to the right in FIG. 1. On the contrary, in the lower surface, the deceleration is performed when the subject moving body 102 moves from the right to the left.

Furthermore, the acceleration and deceleration device 100 may be a unit device including: a swing yoke 41 which is provided so as to intersect the U-shaped member 40, a skip rail 25 which guides the swing yoke 41 along a predetermined second track, and travel support roller guiding rails 35 and 37 which guide the driving shaft 103 along a predetermined track.

In this case, as in the embodiment, the angle of the U-shaped member changes with a change in relationship of a distance and a position between the first track and the second track. The position of the driving shaft changes with a distance between the travel support roller guiding rail and the first track and the angle of the U-shaped member.

As the application example of the acceleration and deceleration device 100 of the first embodiment of the invention, an acceleration and deceleration escalator 101 which includes an acceleration and deceleration device will be exemplified. In the acceleration and deceleration escalator 101, the subject moving body 102 is a pallet 1, and the driving shaft 103 is a pallet driving shaft 53.

Figure 2A:
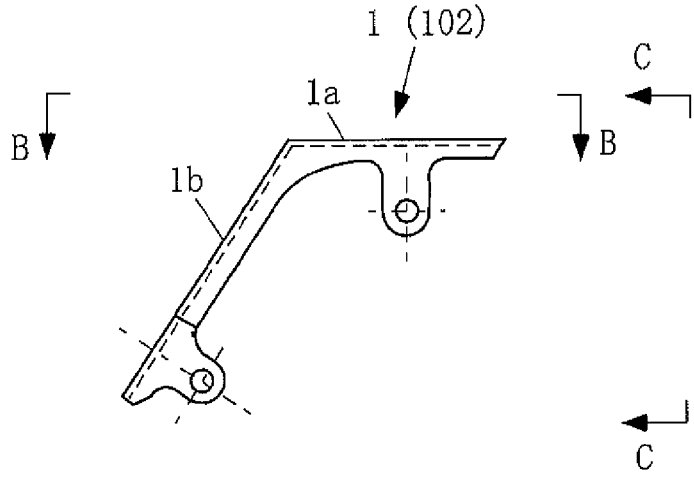
FIG. 2A is a side view illustrating a step (a pallet) which is used in an acceleration and deceleration escalator according to the invention.
Figure 2B:
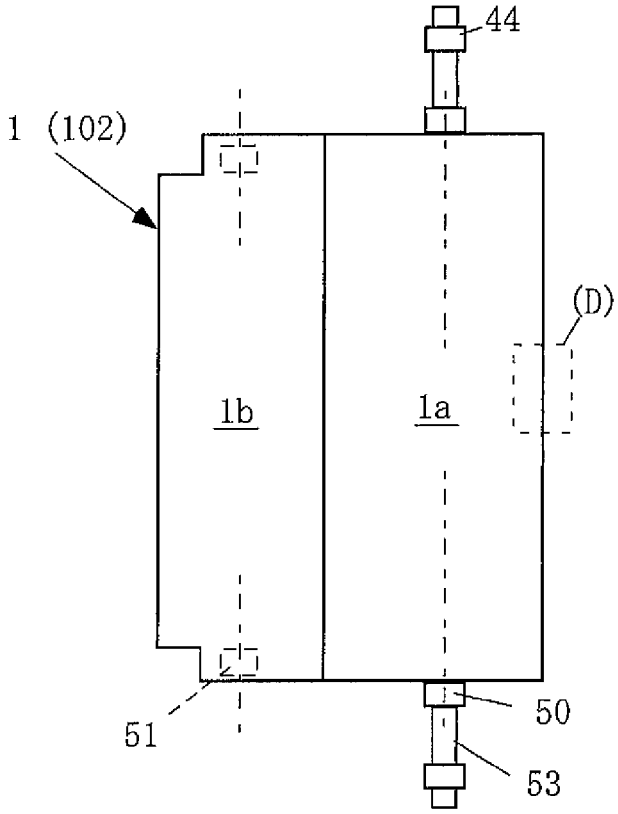
FIG. 2B is a diagram (a plan view) when seen along the line B-B of FIG. 2A.
Figure 2C:
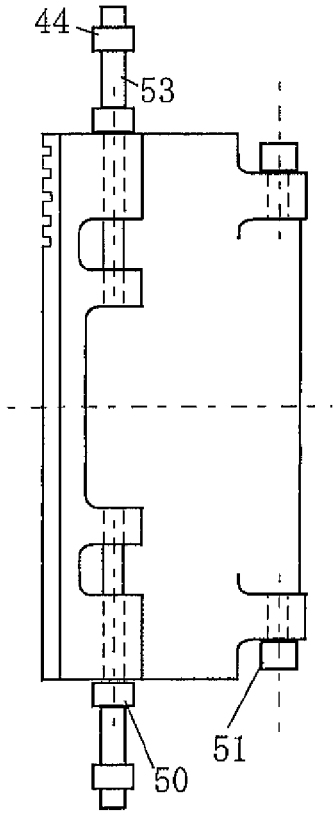
FIG. 2C is a diagram (a rear view) when seen along the line C-C of FIG. 2A.
Figure 2D:
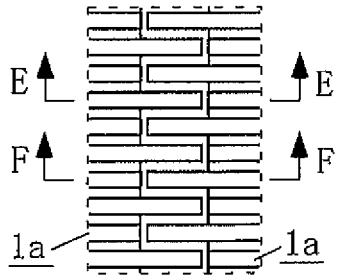
FIG. 2D is an enlarged view illustrating a part (D) in FIG. 2B, that is, an enlarged view illustrating a state where uneven grooves of adjacent pallets 1 in a first low-speed portion and a second low-speed portion mesh with each other.
Figure 2E:
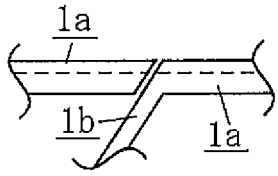
FIG. 2E is a cross-sectional view taken along the line E-E of FIG. 2D.

FIG. 2A is a side view illustrating a step (a pallet) which is used in the acceleration and deceleration escalator 101 according to the invention. FIG. 2B is a diagram (a plan view) when seen from the line B-B of FIG. 2A, and FIG. 2C is a diagram (a rear view) when seen from the line C-C of FIG. 2A. Furthermore, FIG. 2D is an enlarged view illustrating a part (D) of FIG. 2B and is an enlarged view illustrating a state where uneven grooves of the adjacent pallets 1 of the first low-speed portion and the second low-speed portion mesh with each other. Furthermore, FIG. 2E is a cross-sectional view taken along the line E-E of FIG. 2D, and FIG. 2F is a cross-sectional view taken along the line F-F of FIG. 2D.

As shown in FIGS. 2A and 2B, each pallet 1 includes a horizontal footplate 1*a* on which a person gets on and an inclined plate 1*b* which obliquely extends downward from the end portion of the footplate 1*a* (the rear edge in the advancing direction). The footplate 1*a* and the inclined plate 1*b* are integrally molded with each other.

Figure 2F:
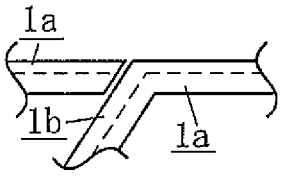
FIG. 2F is a cross-sectional view taken along the line F-F of FIG. 2D.

Furthermore, as shown in FIGS. 2D and 2F, the outer surfaces of the footplate 1*a* and the inclined plate 1*b* are provided with uneven grooves along the same line, and the convex portions of the uneven groove alternately mesh with the concave portions of the adjacent pallet 1. Accordingly, the linear gap between the pallet 1 and the pallet 1 is removed, and hence the safety improves.

In FIGS. 2B and 2C, both sides of the lower portion of the footplate 1*a* (the upper and lower sides of FIG. 2C) are provided with the pallet driving shafts 53 which extend outward in the horizontal direction, and the base portion thereof is provided with a travel support roller 50 and a slide roller 44. Furthermore, both sides of the lower portion of the inclined plate 1*b* (the upper and lower sides of FIG. 2C) are provided with posture rollers 51 which are installed inside both end portions.

The travel support roller 50 is a bearing member which is rotatable about the center of the horizontal axis of the pallet driving shaft 53, and has a function of supporting both ends of the pallet 1. Furthermore, the posture roller 51 is a bearing member which is rotatable about the horizontal axis, and has a function of horizontally holding the footplate 1*a*. Furthermore, the pallet driving shaft 53 has a function of guiding and moving the pallet 1 along a predetermined track.

Figure 3A:
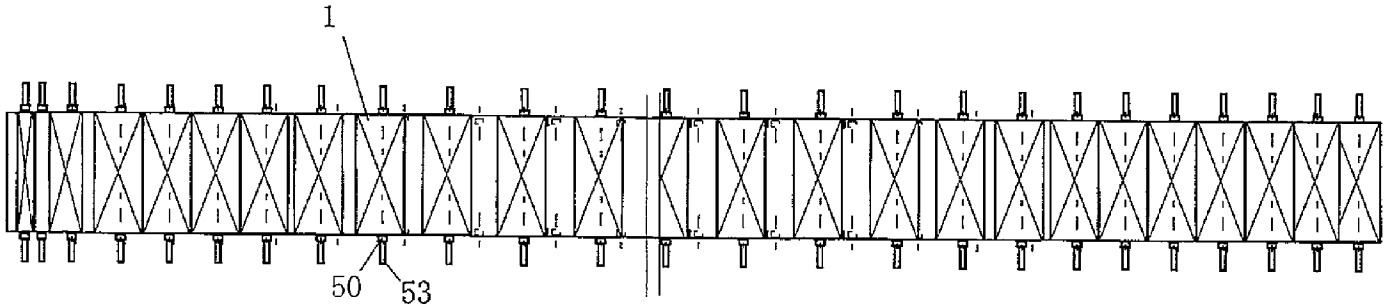
FIG. 3A is a plan view illustrating the arrangement of the pallets in the acceleration and deceleration escalator of the invention.
Figure 3B:
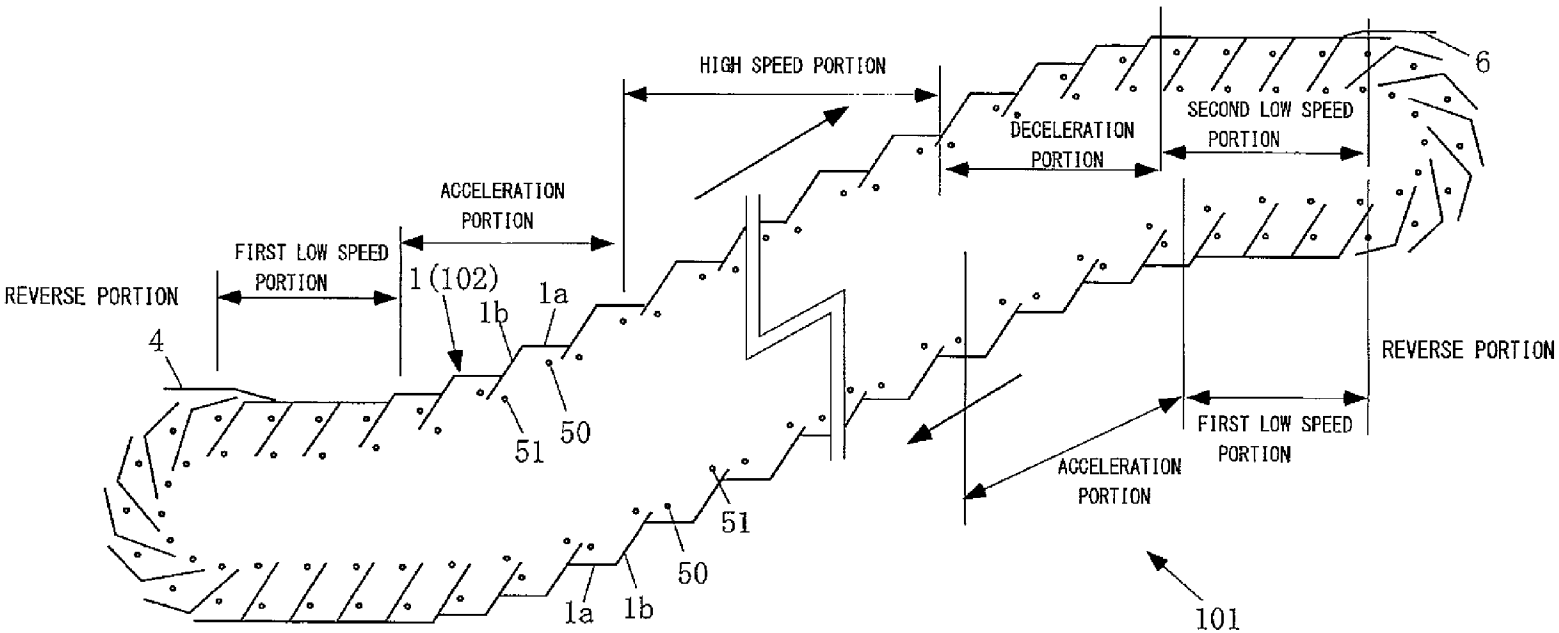
FIG. 3B is a side view illustrating the arrangement of the pallets in the acceleration and deceleration escalator of the invention.

FIG. 3A is a plan view illustrating the arrangement of the pallets of the acceleration and deceleration escalator 101 of the invention, and FIG. 3B is a side view illustrating the arrangement of the acceleration and deceleration escalator 101 of the invention. Furthermore, these drawings correspond to the case of the ascending escalator, and illustrate a case where the planar moving track from the lower step to the upper step is linear.

As shown in FIG. 3B, in the case of the ascending escalator, the escalator includes a speed region which is divided into a first low-speed portion, an acceleration portion, a high-speed portion, a deceleration portion, and a second low-speed portion which are sequentially provided in the advancing direction from the lower step to the upper step.

That is, in the upper surface side on which a person gets, the first low-speed portion, the acceleration portion, the high-speed portion, the deceleration portion, and the second low-speed portion are sequentially arranged from the lower step to the upper step. In the lower surface side (the returning side) on which the person does not get, the first low-speed portion, the acceleration portion, the high-speed portion, the deceleration portion, and the second low-speed portion are sequentially arranged from the upper step to the lower step. Furthermore, both end portions of the lower step and the upper step are reversing portions.

In the respective speed regions of the invention, the chains of the respective pallets 1 are respectively independent from each other.

In the first low-speed portion (the entrance) of the lower step, the footplate 1*a* approaches the first low-speed portion, and the person gets on the footplate 1*a* from a lower comb 4.

In the acceleration portion, the pallet 1 ascends with a constant slope, the moving speed of the pallet 1 is accelerated, and the gap between the footplates 1*a* is gradually widened as well as the inclined plate 1*b* is exposed due to this acceleration. The inclination angle of the inclined plate 1*b* is set to a steep slope with the same angle with respect to the footplate 1*a* so that no gap is formed between the adjacent pallets 1, and hence the person may not get on the inclined plate 1*b*.

In the high-speed portion, the pallet 1 ascends with the same slope as well as the gap between the footplates 1*a* becomes maximum, so that the exposure amount of the inclined plate 1*b* becomes maximum.

In the deceleration portion, the pallet 1 ascends with the same curve as well as the moving speed of the pallet 1 is decelerated. Also, the gap between the adjacent footplates 1*a* is gradually narrowed and the inclined plate 1*b* is not visible from the viewing angle of the user due to this deceleration.

In the second low-speed portion (the exit) of the upper step, the footplate 1*a* approaches the second low-speed portion, and the person gets off from the footplate 1*a* onto the upper comb 6.

By the structure and the arrangement of the pallet, no gap is formed between the adjacent pallets 1 even when the advancing speed of the pallet 1 changes such that the moving speed becomes slow at the platform, becomes accelerated at the intermediate portion, becomes a high speed, and becomes decelerated.

Furthermore, in the first low-speed portion and the second low-speed portion, the convex portions of the footplate 1*a* alternately mesh with the convex portions of the adjacent footplate 1*a*, so that no gap is formed between the adjacent pallets 1. Then, even in the acceleration portion, the high-speed portion, and the deceleration portion, the convex portions of the footplate 1*a* alternately mesh with the concave portions of the inclined plate 1*b*, so that no gap is formed between the adjacent pallets 1.

In this way, the advancing speed of the pallet 1 may become a high speed in the high-speed portion and the moving speed of the pallet may become a low speed in the platform, which may reduce accidents such as rollover of aged persons or children.

Figure 4:
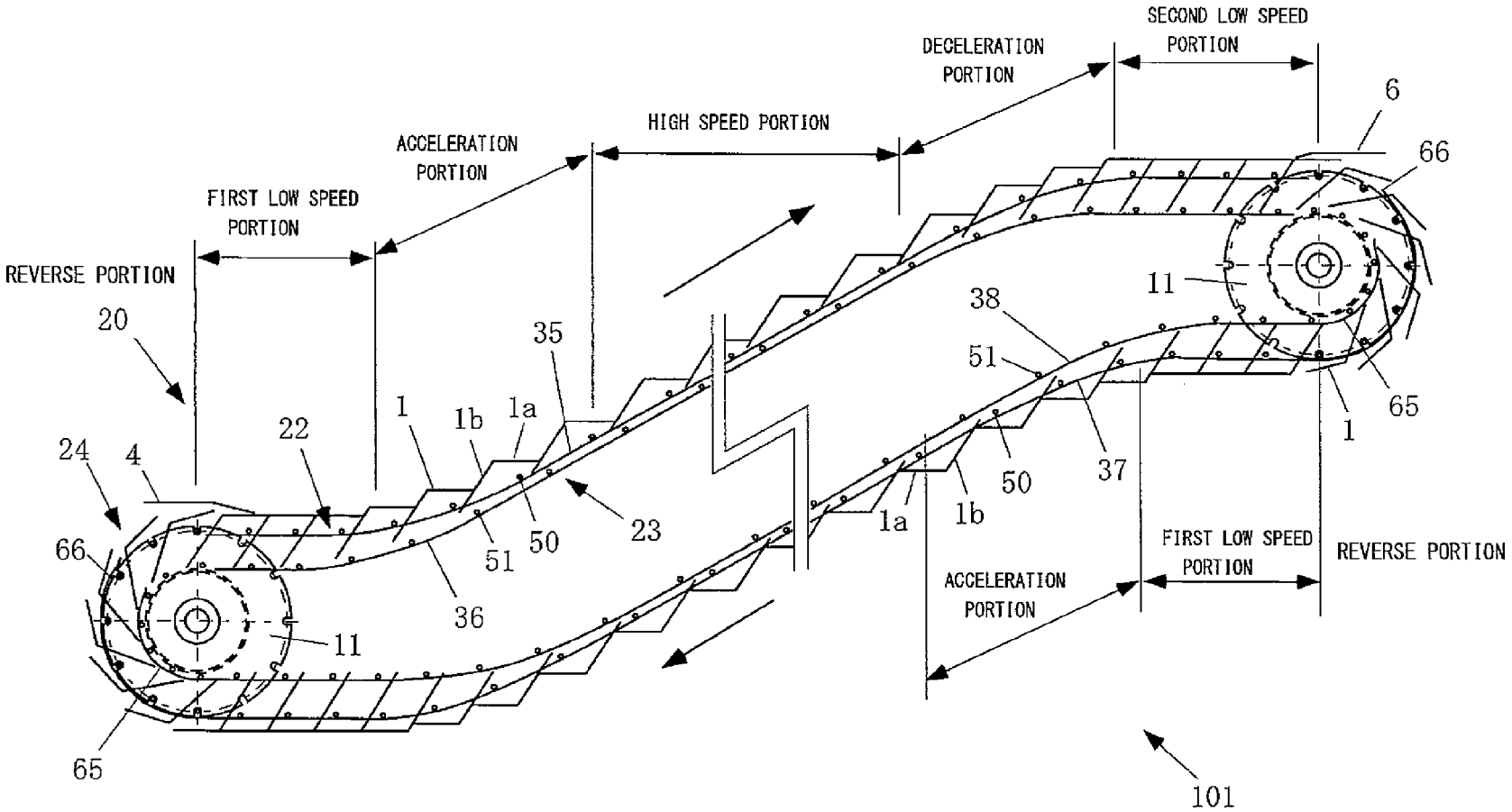
FIG. 4 is a configuration diagram illustrating a guide which guides the pallets in the acceleration and deceleration escalator of FIG. 3B.

FIG. 4 is a configuration diagram illustrating a guiding device which guides the pallet 1 in the acceleration and deceleration escalator 101 of FIG. 3B.

As shown in this drawing, a guiding device 20 includes: a travel support roller guiding device 22 which guides the travel support roller 50 along the arrangement; a posture roller guiding device 23 which guides the posture roller 51 so that the upper surface of the footplate 1*a* is horizontally held, and a pallet reversing device 24 which turns each pallet at both end portions thereof in the advancing direction so that the pallet is reversed.

In this example, the travel support roller guiding device 22 includes the travel support roller guiding rails 35 and 37, and guides the travel support roller 50 attached to the pallet driving shaft 53 along a predetermined track.

In this example, the posture roller guiding device 23 includes the posture roller guiding rails 36 and 38. The posture roller guiding rails 36 and 38 are installed so as to be away from the lower side of the pallet 1, and do not interfere with the pallet 1.

The pallet reversing device 24 includes a pallet reversing wheel 11, a posture roller reversing and supporting rail 65, and a slide roller reversing and supporting rail 66.

Figure 5A:
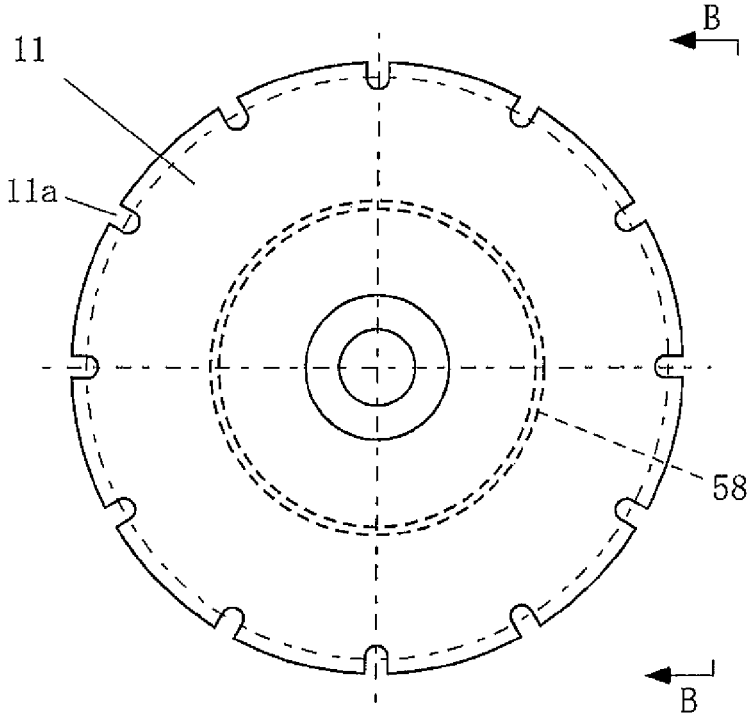
FIG. 5A is a side view illustrating a pallet reversing wheel.
Figure 5B:
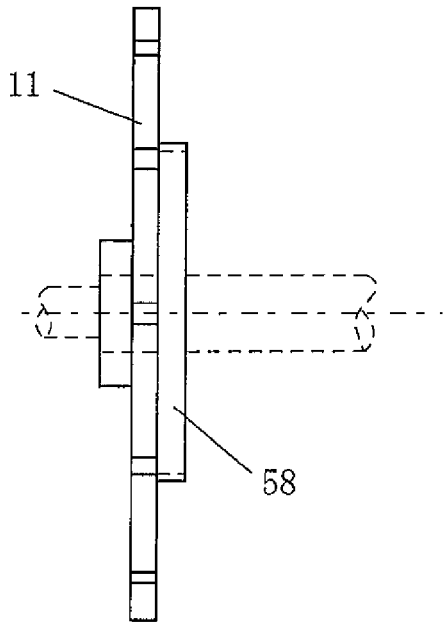
FIG. 5B is a diagram when seen from the line B-B of FIG. 5A.

FIG. 5A is a side view illustrating the pallet reversing wheel 11. FIG. 5B is a diagram when seen from the line B-B of FIG. 5A.

Four pallet reversing wheels 11 are installed in total at both end portions of the acceleration and deceleration escalator 101 in the advancing direction, where two pallet reversing wheels are installed at both sides of the reversing portion of the lower step and two pallet reversing wheels are installed at both sides of the reversing portion of the upper step.

Each pallet reversing wheel 11 is formed as a disk-like member, and the outer circumferential edge thereof is provided with grooves 11*a* which are arranged at the same interval in the circumferential direction so as to be fitted to the travel support rollers 50 of the pallets 1.

Furthermore, a ring rail 58 which is formed in an annular shape is integrally connected to the inner surface of the pallet reversing wheel 11. Furthermore, the pallet reversing wheels 11 which are installed at both sides and make a pair is connected to each other through the same shaft (not shown), and each pair is rotationally driven by a wheel driving device (not shown).

By the above-described configuration of the pallet reversing wheel 11, the travel support roller 50 of the pallet 1 is fitted to the groove 11*a* of the pallet reversing wheel 11 in both end portions of the acceleration and deceleration escalator 101 in the advancing direction, and the posture roller 51 of the pallet 1 is supported in the outer peripheral surface of the ring rail 58, thereby turning the pallet 1 along the outer periphery of the pallet reversing wheel 11 so that the pallet is reversed.

In FIG. 4, the posture roller reversing and supporting rail 65 is formed in a circular arc shape with a gap which is formed between the outer peripheral surface of the ring rail 58 and the posture roller reversing and supporting rail so as to allow the posture roller 51 to pass therethrough, thereby preventing the posture roller 51 from falling from the outer peripheral surface of the ring rail 58 when the pallet 1 is reversed.

Furthermore, the slide roller reversing and supporting rail 66 is formed in a circular arc shape along the outer peripheral surface of the pallet reversing wheel 11, and prevents the pallet driving shaft 53 from falling from the outer peripheral surface of the pallet reversing wheel 11 when the pallet 1 is reversed.

In the above-described configuration, the travel support roller 50 is wound on the pallet reversing wheel 11, and the posture roller 51 is reversed by transferring onto the ring rail 58 which is provided inside the pallet reversing wheel 11 so as to be positioned at the same level as the traveling surfaces of the pallet traveling rails 36 and 38.

Further, in order to prevent the deviation between the pallet reversing wheel 11 and the pallet 1 during the reversing operation, the slide roller 44 is supported by the slide roller reversing and supporting rail 66, and the posture roller 51 is supported by the posture roller reversing and supporting rail 65.

In FIG. 4, the travel support roller guiding rails 35 and 37 guide each travel support roller 50 of the pallet 1 along a predetermined track in the first low-speed portion, the acceleration portion, the high-speed portion, the deceleration portion, and the second low-speed portion. The same applies to the case where the pallet returns (the lower portion of the escalator).

Furthermore, the posture roller guiding rails 36 and 38 guide each posture roller 51 of the pallet 1 so that each footplate 1*a* is horizontally maintained in the first low-speed portion, the acceleration portion, the high-speed portion, the deceleration portion, and the second low-speed portion. The same applies to the case where the pallet returns (the lower portion of the escalator).

Figure 6:
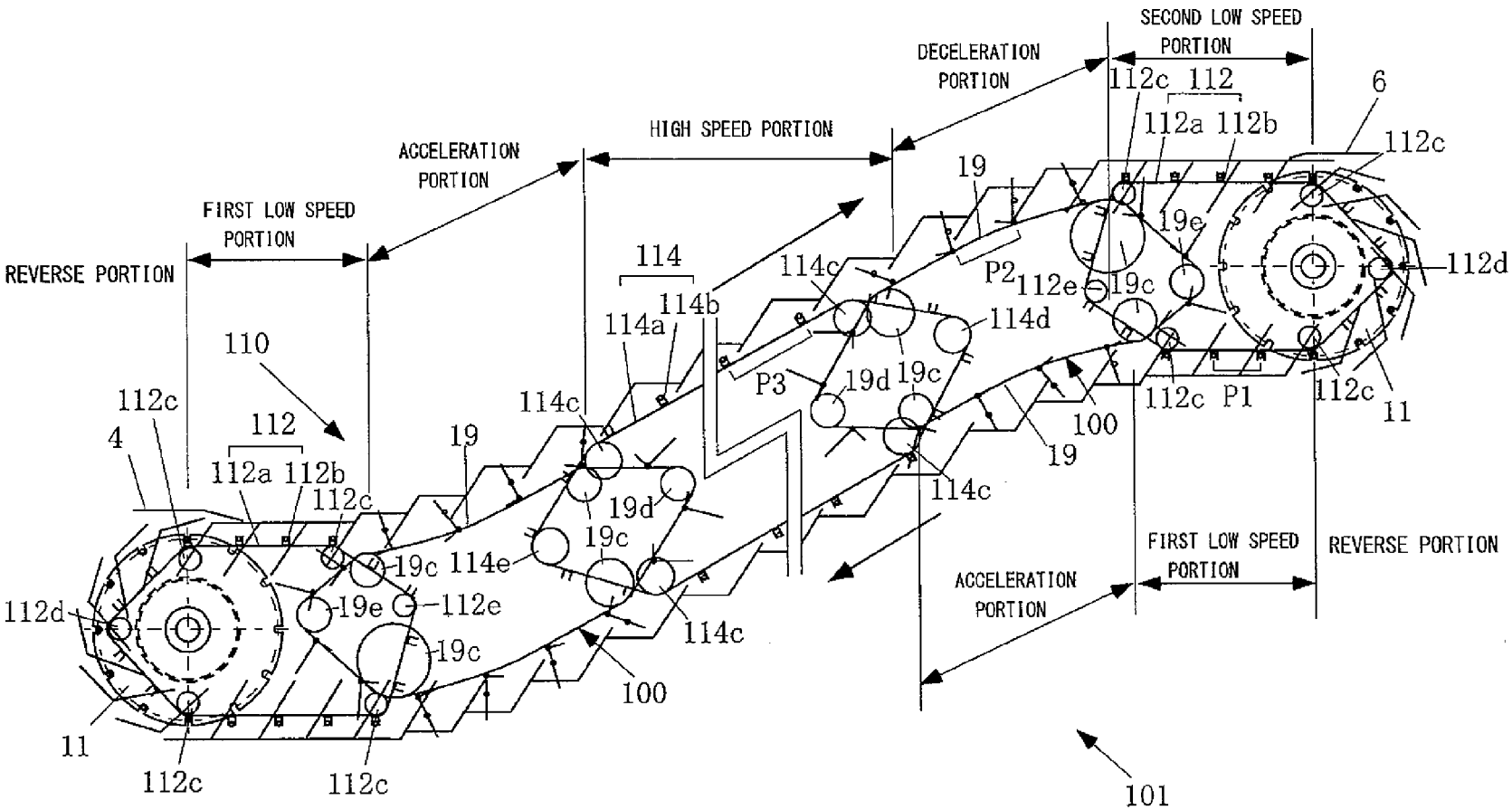
FIG. 6 is a configuration diagram illustrating a driving device of the first embodiment and an acceleration and deceleration device of the first embodiment driving the respective pallets of FIG. 3B at every speed region.

FIG. 6 is a configuration diagram illustrating the driving device 110 of the first embodiment and the acceleration and deceleration device 100 of the first embodiment driving the respective pallets of FIG. 3B at every speed region.

As shown in this drawing, the driving device 110 includes a low-speed chain driving device 112 which drives the pallets of the first low-speed portion and the second low-speed portion at a predetermined first low speed and a high-speed chain driving device 114 which drives the pallet of the high-speed portion at the above-described high speed. Furthermore, in the acceleration and deceleration device 100 of the first embodiment, the upper surface of the acceleration portion which comes into contact with the pallet 1 accelerates the pallet 1 from the first low speed to the high speed faster than the first low speed, and the surface of the deceleration portion which comes into contact with the pallet 1 decelerates the pallet 1 from the above-described high speed to a predetermined second low speed slower than the above-described high speed. Furthermore, the lengths of the respective chains are set to be an integer number of times of the component attachment pitches P1, P2, and P3 of the respective chains.

In the respective chain driving devices of the driving device 110 of the first embodiment and the respective chain driving devices of the acceleration and deceleration device 100 of the first embodiment, different chains are driven in the respective regions.

The chain speed is V1 at the first low-speed portion (the entrance), V2 at the acceleration portion, V3 at the high-speed portion, V2 at the deceleration portion, and V1 at the second low-speed portion (the exit). The values of the speeds V1 at the entrance and the exit are the same in this example, but may be different.

Two low-speed chain driving devices 112 of the first embodiment are installed in total at both left and right sides of the first low-speed portion of the lower step. Each low-speed chain driving device 112 includes: a chain 112*a* which endlessly rotates in the horizontal direction; plural drive attachments 112*b* which are attached to the chain 112*a* at the same pitch P1 and are fitted to the pallet driving shafts 53 of the pallets 1 positioned at the first low-speed portion; and six sprockets 112*c*, 112*d*, and 112*e* which mesh with the chain 112*a* and rotate at the same low speed V1.

The sprocket 112*c* corresponds to four sprockets which are positioned at both ends of the chain coming into contact with the pallet 1. The take-up sprocket 112*d* is installed between the upper and lower sprockets 112*c* on the side of the pallet reversing wheel 11. The take-up sprocket 112*e* is installed between the upper and lower sprockets 112*c* between the first low-speed portion and the acceleration portion.

Then, the plural pallets 1 which are positioned at the upper and lower sides of the first low-speed portion of the lower step are horizontally driven at the same low speed V1.

The low-speed chain driving device of the second low-speed portion has a configuration in which the low-speed chain 112 of the first low-speed portion is installed while being reversed in the vertical direction, and two low-speed chain driving devices are installed in total at both sides of the second low-speed portion of the upper step.

Two high-speed chain driving devices 114 of the first embodiment are installed in total at both sides of the high-speed portion. Each high-speed chain driving device 114 includes: a chain 114*a* which endlessly rotates with the same slope; plural drive attachments 114*b* which are attached to the chain 114*a* at the same pitch P3 and are fitted to the pallet driving shafts 53 of the pallets 1 positioned at the high-speed portion; four sprockets 114*c* which mesh with the chain 114*a* and rotate at the same high speed V3; a high-speed chain take-up sprocket 114*d* which is positioned between the upper and lower sprockets 114*c* positioned at the boundary between the high-speed portion and the deceleration portion, and a take-up sprocket 114*e* which is positioned between the upper and lower sprockets 114*c* positioned at the boundary between the acceleration portion and the high-speed portion. Then, the plural pallets 1 positioned at the upper and lower high-speed portions are driven at the same high speed V3 with the same slope.

In the acceleration and deceleration device 100 of the first embodiment of the acceleration portion, the upper surface serves as the acceleration device, and the lower surface serves as the deceleration device. Two acceleration and deceleration devices are installed in total at both left and right sides of the acceleration portion so that the surface serving as the acceleration device is directed upward. Then, two acceleration and deceleration devices are installed in total at both left and right sides of the deceleration portion so that the surface serving as the deceleration device is directed upward. In the acceleration portion, the upper surface of the acceleration and deceleration device 100 of the first embodiment has a function of accelerating the moving speed of the pallet 1 from the low speed of the first low-speed portion to the high speed of the high-speed portion. On the contrary, in the deceleration portion, the lower surface of the acceleration and deceleration device 100 of the first embodiment has a function of decelerating the moving speed of the pallet 1 from the high speed of the high-speed portion to the low speed of the second low-speed portion.

The detail of the acceleration and deceleration device 100 of the first embodiment will be described later.

Furthermore, in a case where the acceleration and deceleration escalator 101 of the first embodiment of the invention is used for a descending purpose, the chain 19 of the acceleration and deceleration device of the first embodiment reversely rotates.

The pallet pitch P3 of the high-speed traveling portion is the same as the pitch of two footplates on the downstream side of the acceleration region and the pitch of two footplates on the upstream side of the deceleration region.

Further, the speed V2 of the acceleration and deceleration device 100 of the first embodiment is set to a constant speed as fast as the length ratio of the attachment pitch P2 of the slide pressing fitting (the U-shaped member) 40 with respect to the shortest pitch P1 of the pallet 1 (the most contracted state of the pallet). That is, the chain speed V2 of the acceleration portion and the deceleration portion may be expressed by Equation (1).

$$V2=V1\times(P2/P1) \quad (1)$$

This is because the U-shaped groove portion of the slide pressing fitting 40 and the slide roller 44 sent at the same interval of the shortest pitch P1 of the pallet 1 at the "thrust connection point" between the first low-speed portion and the acceleration portion are fitted to each other at the "thrust connection point" at the same timing.

FIG. 1 is a side view illustrating the acceleration and deceleration device of the first embodiment.

In this drawing, P1 indicates the pitch of the drive attachment 112*b* of the first low-speed chain driving device 112, P2 indicates the pitch of the slide pressing fitting 40 of the acceleration and deceleration device of the first embodiment, and P3 indicates the pitch of the drive attachment 114*b* of the high-speed chain driving device 114, and the pitches have a relationship of P3>P2>P1.

In the thrust connection points of the respective speed regions, in order to smoothly maintain the thrust, the respective chain driving forces are overlapped at the thrust connection point and the pallet 1 is sequentially transmitted to the next speed region.

In FIG. 1, a chain traveling roller 47 of the acceleration and deceleration device 100 of the first embodiment is guided along a predetermined track by the acceleration and deceleration chain traveling rail 60 (see FIG. 10), and the skip roller 46 is guided by the skip rail 25 along a predetermined track. Then, the slide pressing fitting 40 swings about the connection shaft 42, and moves along the chain 19 of the acceleration and deceleration device 100 of the first embodiment at an angle of the pallet 1 which is determined by the chain traveling rail 60 and the skip rail 25.

The U-shaped member of the slide pressing fitting 40 clamps the slide roller 44 (see FIG. 10) which is provided in the pallet driving shaft 53 at the thrust connection point between the first low-speed portion and the acceleration portion, and accelerates and drives the pallet 1 by the thrust generated by the traveling operation of the chain 19 and the thrust generated by a change in angle of the slide pressing fitting 40.

That is, the slide pressing fitting 40 is docked into the slide roller 44 which is attached to the pallet driving shaft 53 of the pallet 1, and then travels in a manner of being inclined in the advancing direction while sliding inside the U-shaped groove and maintaining the thrust of the pallet 1.

Furthermore, the traveling roller 50 travels on the traveling rails 35 and 37 which include the lift preventing rail 59 (see FIG. 10) so that the pallet 1 is not lifted during the driving operation using the slide pressing fitting 40.

Further, the posture roller 51 of the pallet 1 travels along the rails 36 and 38.

Furthermore, immediately before the slide roller 44 (see FIG. 10) attached to the pallet driving shaft 53 comes out from the front end portion of the U-shaped member of the slide pressing fitting 40 at the thrust connection point between the acceleration portion and the high-speed portion, the pallet driving shaft 53 is fitted to the drive attachment 14*a* of the high-speed chain driving device 14, and the pallet 1 is transmitted to the next speed region while the thrust is maintained.

With the above-described configuration of the acceleration and deceleration device 100, the pallet driving shaft 53 of the pallet 1 moving from the first low-speed portion is clamped by the slide pressing fitting 40, the pallet 1 is accelerated by a change in posture of the slide pressing fitting 40, and the pallet driving shaft 53 is transmitted to the high-speed chain driving device 14 at the thrust connection point between the acceleration portion and the high-speed portion, thereby accelerating the moving speed of the pallet 1 from the low speed of the first low-speed portion to the high speed of the high-speed portion.

Furthermore, as in the driving device 110, the acceleration and deceleration device 100 of the first embodiment includes four sprockets 19*c* which mesh with the chain 19 and rotate at the speed V2, a take-up sprocket 19*d*, and an acceleration and deceleration device take-up sprocket 19*e*.

The sprocket 19*c* corresponds to four sprockets which are positioned at both ends of the chain coming into contact with the pallet 1. The take-up sprocket 19*d* is installed between the upper and lower sprockets 19*c* installed between the acceleration portion and the high-speed portion. The acceleration and deceleration device take-up sprocket 19*e* is positioned between the upper and lower sprockets 19*c* installed between the first low-speed portion and the acceleration portion.

Furthermore, the acceleration and deceleration device 100 of the first embodiment may be installed as the deceleration device by installing the deceleration portion so as to be reversed in the vertical direction.

Furthermore, as shown in FIG. 6, in the acceleration and deceleration escalator 101 which includes the acceleration and deceleration device 100 of the first embodiment and the driving device 110 of the first embodiment, the sprocket is divided into three types.

The sprockets 112*c*, 19*c*, and 114*c* may include a sprocket with a different diameter, and are provided so as to allow the respective chains along a predetermined track.

The take-up sprocket 112*d*, the take-up sprockets 19*d* of the acceleration portion and the deceleration portion, and the high-speed chain take-up sprocket 114*d* are provided so as to match the pitch of the chain and the pitch of the pallet 1 at both the upper surface and the lower surface. That is, at the time when the acceleration and deceleration escalator 101 is assembled, the deviation which is generated between the pitches of the chains 112*a*, 19, and 114*a* and the pitches of the pallet driving shafts 53 at the respective positions are made to match each other by adjusting the positions of the take-up sprocket 112*d*, the take-up sprockets 19*d* of the acceleration portion and the deceleration portion, and the high-speed chain take-up sprocket 114*d*.

Subsequently, the take-up sprocket 112*d*, the take-up sprockets 19*d* of the acceleration portion and the deceleration portion, and the high-speed chain take-up sprocket 114*d* are fixed. The take-up sprocket 112*e*, the take-up sprocket 114*e*, and the acceleration and deceleration device take-up sprocket 19*e* which are provided at the opposite side serve as a general slide take-up.

Figure 7:
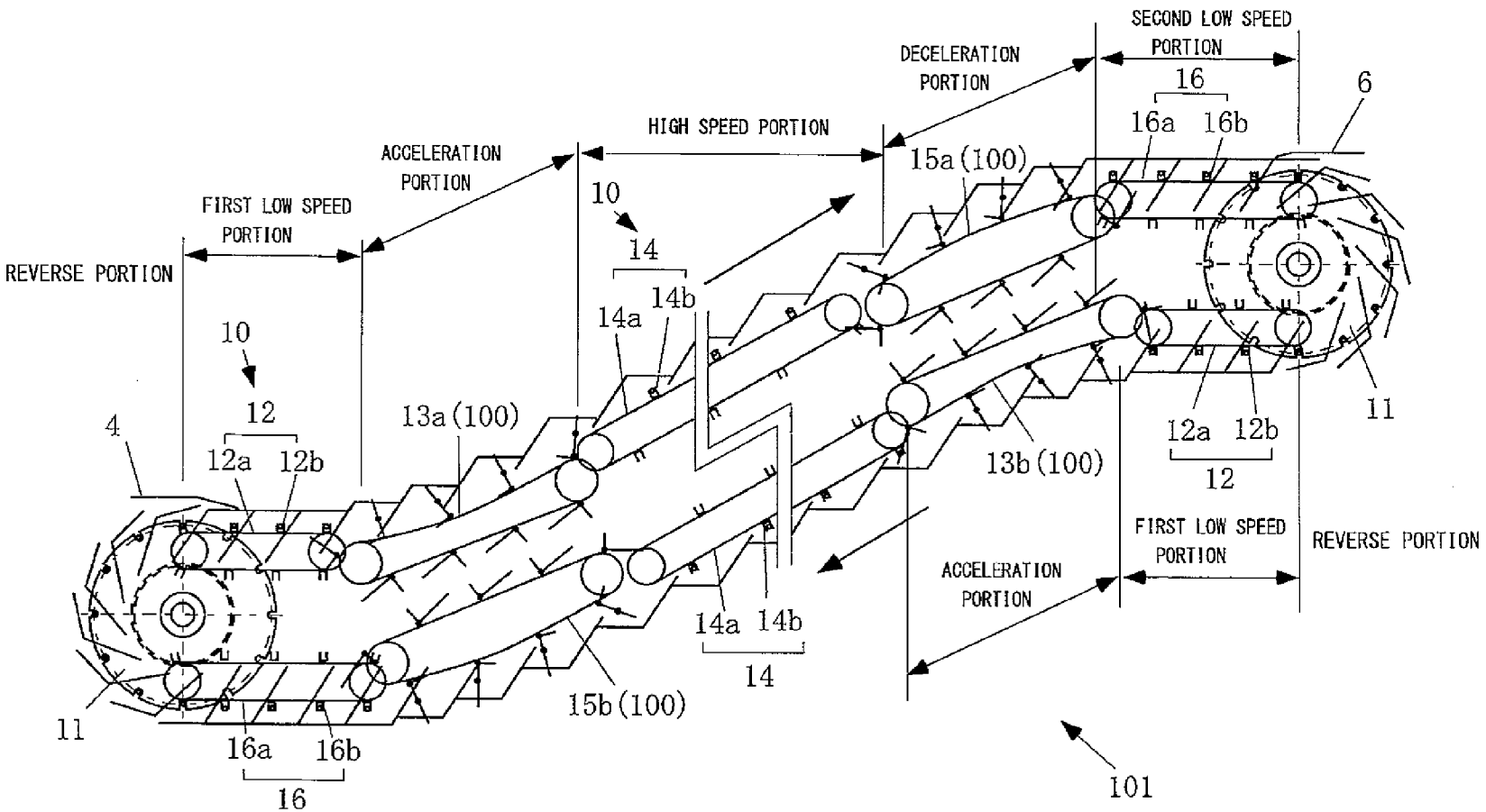
FIG. 7 is a configuration diagram illustrating a driving device of the second embodiment and an acceleration and deceleration device of the second embodiment driving the respective pallets of FIG. 3B at every speed region.

FIG. 7 is a configuration diagram illustrating the driving device 10 of the second embodiment and the acceleration and deceleration device 100 of the second embodiment driving the respective pallets of FIG. 3B at every speed region. The driving device 10 includes: a first low-speed chain driving device 12 which drives the pallet of the first low-speed portion at a predetermined first low speed; a high-speed chain driving device 14 which drives the pallet of the high-speed portion at the above-described high speed; and a second low-speed chain driving device 16 which drives the pallet of the second low-speed portion at a second low speed. Furthermore, the acceleration and deceleration device 100 of the second embodiment includes: acceleration chain driving devices 13*a* and 13*b* which accelerate the pallet of the acceleration portion from the first low speed to the high speed faster than the first low speed and deceleration chain driving devices 15*a* and 15*b* which decelerate the pallet of the deceleration portion from the above-described high speed to a predetermined second low speed slower than the above-described high speed. The lengths of the respective chains are set to be an integer number of times of the component attachment pitches P1, P2, and P3 of the respective chains. Furthermore, the speed of the chain is the same as that of the acceleration and deceleration device of the first embodiment.

In the respective chain driving devices of the driving device 10 and the respective chain driving devices of the acceleration and deceleration device 100 of the second embodiment, different chains are driven in the respective regions.

The chain speed is V1 at the first low-speed portion (the entrance), V2 at the acceleration portion, V3 at the high-speed portion, V2 at the deceleration portion, and V1 at the second low-speed portion (the exit). The values of the speeds V1 at the entrance and the exit are the same in this example, but may be different.

Four first low-speed chain driving devices 12 are installed in total at both sides of the upper side of the first low-speed portion of the lower step and both sides of the lower side of the second low-speed portion of the upper step. Each first low-speed chain driving device 12 includes: a chain 12*a* which endlessly rotates in the horizontal direction and plural drive attachments 12*b* which are attached to the chain 12*a* at the same pitch P1 and are fitted to the pallet driving shafts 53 of the pallets 1 positioned at the first low-speed portion, thereby driving the plural pallets 1 positioned at the upper side of the first low-speed portion of the lower step and the lower side of the second low-speed portion of the upper step at the same low speed V1 in the horizontal direction.

Four second low-speed chain driving devices 16 are installed in total at both sides of the lower side of the first low-speed portion of the lower step and both sides of the upper side of the second low-speed portion of the upper step. Each second low-speed chain driving device 16 is the same as the first low-speed chain driving device 12 except for the length thereof, and includes: a chain 16*a* which endlessly rotates in the horizontal direction and plural drive attachments 16*b* which are attached to the chain 16*a* at the same pitch P1 and are fitted to the pallet driving shafts 53 of the pallets 1 positioned at the second low-speed portion, thereby driving the plural pallets 1 positioned at the lower side of the first low-speed portion of the lower step and the upper side of the second low-speed portion of the upper step at the same low speed V1 in the horizontal direction.

Four high-speed chain driving devices 14 are installed in total at both sides of the upper and lower high-speed portions. Each high-speed chain driving device 14 includes: a chain 14*a* which endlessly rotates at the same slope and plural drive attachments 14*b* which are attached to the chain 14*a* at the same pitch P3 and are fitted to the pallet driving shafts 53 of the pallets 1 positioned at the high-speed portion, thereby driving the plural pallets 1 positioned at the upper and lower high-speed portions at the same high speed V3 with the same slope.

In this (ascending) example, the acceleration chain driving devices 13*a* and 13*b* are used for the acceleration purpose, and four acceleration chain driving devices are installed in total at both sides of the upper side of the acceleration portion of the lower step and both sides of the deceleration portion of the upper step. As in the acceleration and deceleration device 100 of the first embodiment, the acceleration chain driving devices 13*a* and 13*b* have a function of accelerating the moving speed of the pallet 1 from the low speed of the first low-speed portion to the high speed of the high-speed portion.

The detail of the acceleration chain driving devices 13*a* and 13*b* will be described later.

In this (ascending) example, the deceleration chain driving devices 15*a* and 15*b* are used for the deceleration purpose, and four deceleration chain driving devices are installed in total at both sides of the upper side of the deceleration portion of the upper step and both sides of the lower side of the acceleration portion. The deceleration chain driving devices 15*a* and 15*b* have a function of decelerating the moving speed of the pallet 1 from the high speed of the high-speed portion to the low speed of the second low-speed portion.

The detail of the deceleration chain driving devices 15*a* and 15*b* will be described later.

Furthermore, when the acceleration and deceleration escalator 101 of the invention is used for the descending purpose, the acceleration chain driving devices 13*a* and 13*b* are used for the deceleration purpose, and the deceleration chain driving devices 15*a* and 15*b* are used for the acceleration purpose.

Figure 8:
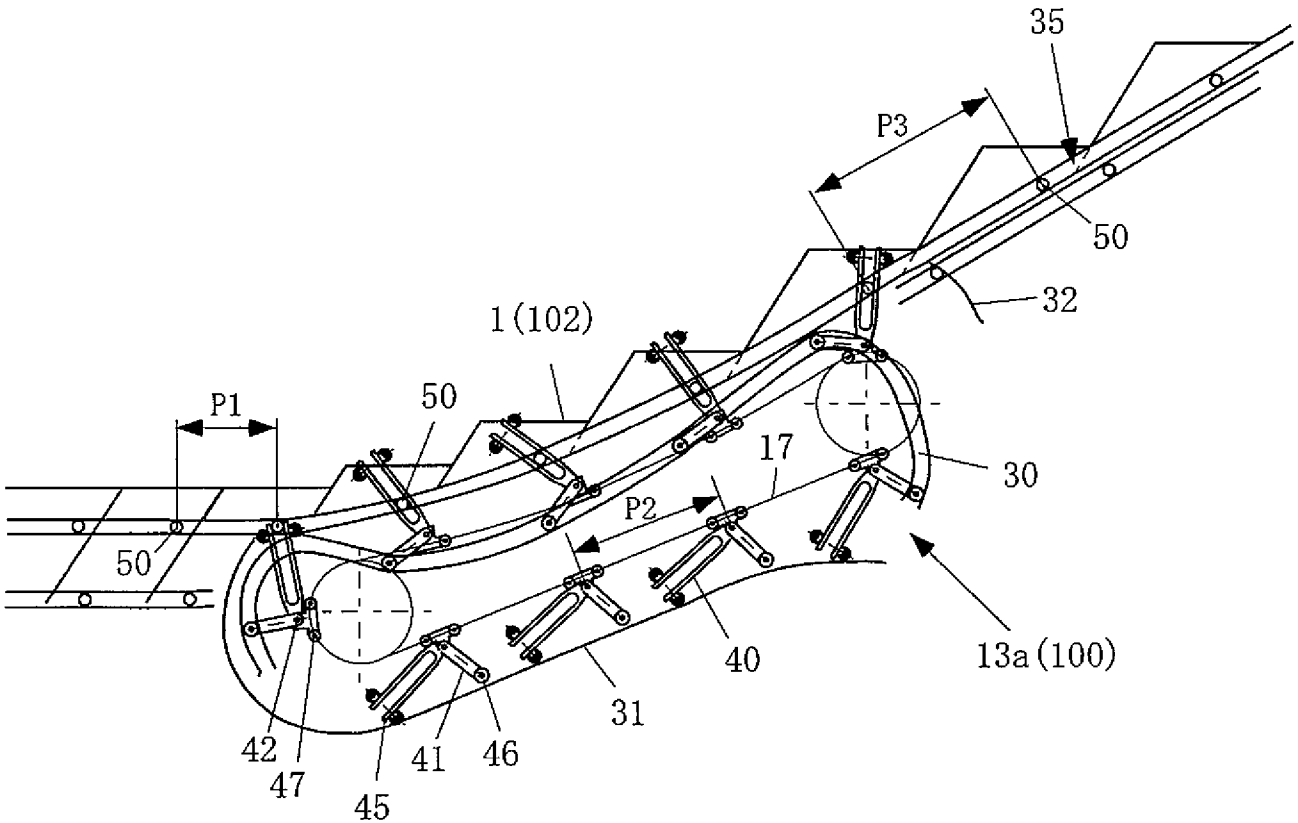
FIG. 8 is a side view illustrating an acceleration chain driving device of the acceleration and deceleration device of the second embodiment.

FIG. 8 is a side view illustrating the acceleration chain driving device 13*a* of the acceleration and deceleration device 100 of the second embodiment.

In this drawing, P1 indicates the pitch of the drive attachment 12*b* of the first low-speed chain driving device 12, P2 indicates the pitch of the slide pressing fitting 40 of the acceleration chain driving device 13*a*, and P3 indicates the pitch of the drive attachment 14*b* of the high-speed chain driving device 14, and the pitches have a relationship of P3>P2>P1.

In the thrust connection points of the respective speed regions, in order to smoothly maintain the thrust, the respective chain driving forces are overlapped at the thrust connection point and the pallet 1 is sequentially transmitted to the next speed region.

In FIG. 8, the chain traveling roller 47 of the first acceleration chain driving device 13*a* is guided along a predetermined track by the acceleration and deceleration chain traveling rail 60 (see FIG. 10), and the skip roller 46 is guided along a predetermined track by the skip rail 30. Furthermore, the skip rails 30 and 26 are not endlessly formed as in those of FIGS. 8 and 9, and are set only a portion which demands a thrust and a posture control. Accordingly, the slide pressing fitting 40 swings about the connection shaft 42, and moves along the upper chain 17 of the first acceleration chain driving device 13*a* while changing according to the angle of the pallet 1 which is determined by the chain traveling rail 60 and the skip rail 30.

The U-shaped member of the slide press attachment 40 clamps the slide roller 44 which is provided in the pallet driving shaft 53 at the thrust connection point between the first low-speed portion and the acceleration portion, and accelerates and drives the pallet 1 with a change in angle of the slide press attachment 40.

That is, the slide press attachment 40 is docked into the slide roller 44 which is attached to the pallet driving shaft 53 of the pallet 1, and then travels in a manner of being inclined in the advancing direction while sliding inside the U-shaped groove and maintaining the thrust of the pallet 1.

There is a need for the slide press attachment 40 to smoothly follow the movement of the chain 17 of the first acceleration chain driving device 13*a*, and since this smooth following movement is dependent on which side of the slide press attachment with respect to the swing yoke 41 falls in the advancing direction of the chain 17 of the acceleration chain driving device 13*a*, the slide press attachment 40 is supported so that the guide roller 45 follows the connection guide assisting rails 31 and 32 (or the skip roller 46 follows the skip rail 30) at the larger falling side. Furthermore, although the chain 17 of the first acceleration chain driving device 13*a* is driven while being curved in a catenary shape, this is not essentially needed. Although the shape may be linear, the shape is curved since the falling angle of the press attachment is efficiently degraded.

Furthermore, the traveling roller 50 travels on the traveling rails 35 and 37 which include the lift preventing rail 59 (see FIG. 10) so that the pallet 1 is not lifted during the driving operation using the slide press attachment 40.

Further, the posture roller 51 of the pallet 1 travels along the rails 36 and 38.

Furthermore, immediately before the slide roller 44 (see FIG. 10) attached to the pallet driving shaft 53 comes out from the front end portion of the U-shaped member of the slide press attachment 40 at the thrust connection point between the acceleration portion and the high-speed portion, the pallet driving shaft 53 is fitted to the drive attachment 14*a* of the high-speed chain driving device 14, and the pallet 1 is transmitted to the next speed region while the thrust is maintained.

Furthermore, in FIG. 8, the reference signs 31 and 32 indicate connection guide assisting rails which help the slide roller 44 to be easily fitted to the opening portion of the U-shaped groove of the slide press attachment 40 at the positive reversing point.

With the above-described configuration of the acceleration chain driving device 13*a* of the acceleration and deceleration device 100 of the second embodiment, the pallet driving shaft 53 of the pallet 1 moving from the first low-speed portion is clamped by the slide press attachment 40, the pallet 1 is accelerated by a change in posture of the slide press attachment 40, and the pallet driving shaft 53 is transmitted to the high-speed chain driving device 14 at the thrust connection point between the acceleration portion and the high-speed portion, thereby accelerating the moving speed of the pallet 1 from the low speed of the first low-speed portion to the high speed of the high-speed portion.

The structure and the operation of the acceleration chain driving device 13*b* are the same as those of the acceleration chain driving device 13*a*.

Figure 9:
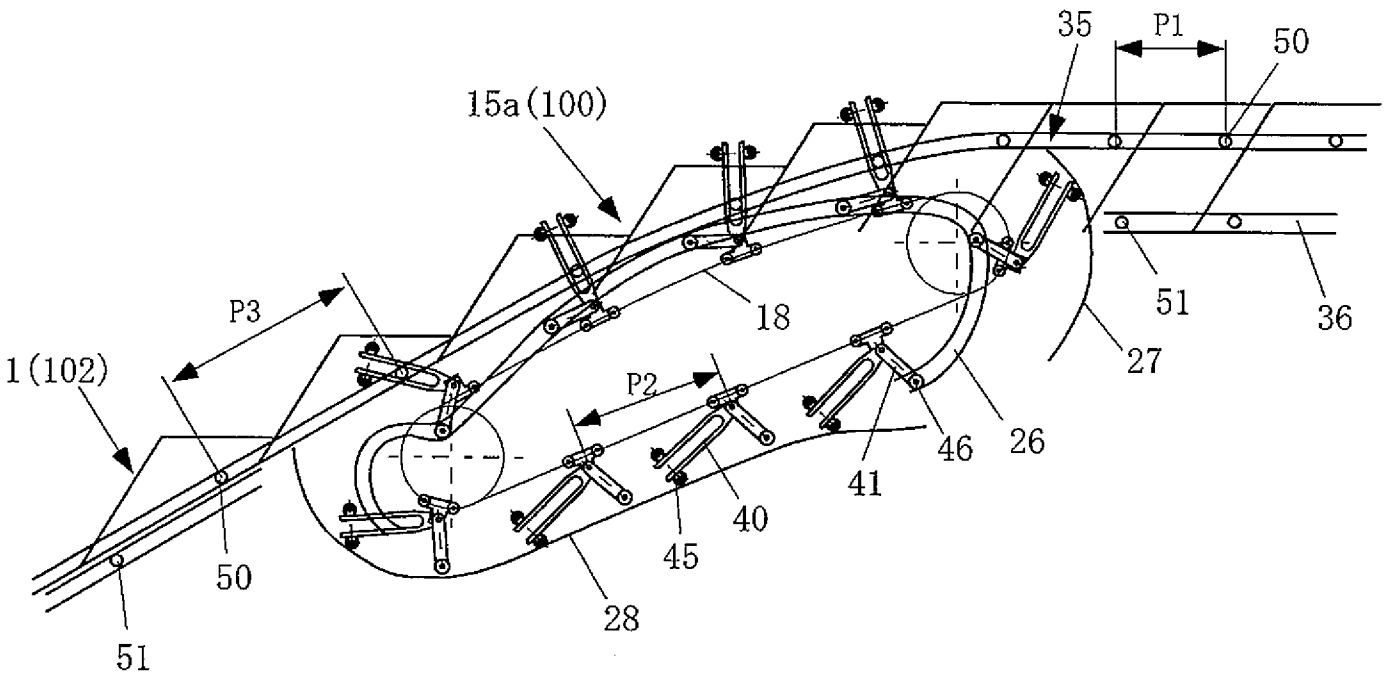
FIG. 9 is a side view illustrating a deceleration chain driving device of the acceleration and deceleration device of the second embodiment.

FIG. 9 is a side view illustrating the deceleration chain driving device 15*a* of the acceleration and deceleration device 100 of the second embodiment.

In this drawing, P1 indicates the pitch of the drive attachment 16*b* of the second low-speed chain driving device 16, P2 indicates the pitch of the slide press attachment 40 of the deceleration chain driving device 15*a*, and P3 indicates the pitch of the drive attachment 14*b* of the high-speed chain driving device 14.

In FIG. 9, the chain traveling roller 47 of the deceleration chain driving device 15*a* is guided along a predetermined track by the acceleration and deceleration chain traveling rail 60 (see FIG. 10), and the skip roller 46 is guided along a predetermined track by the skip rail 26. Accordingly, the slide press attachment 40 swings about the connection shaft 42, and moves along the upper chain 18 of the deceleration chain driving device 15*a* while changing according to the posture determined by the acceleration and deceleration chain traveling rail 60 and the skip rail 26.

The U-shaped member of the slide press attachment 40 clamps the slide roller 44 provided in the pallet driving shaft 53 at the thrust connection point between the high-speed portion and the deceleration portion, and decelerates and drives the pallet 1 according to a change in posture of the slide press attachment 40.

Furthermore, the U-shaped member of the slide press attachment 40 is transmitted to the low-speed chain driving device 16 immediately before the front end portion of the slide roller 44 comes out from the thrust connection point between the deceleration portion and the low-speed portion.

With the above-described configuration of the deceleration chain driving device 15*a*, the slide roller 44 of the pallet 1 moving from the high-speed portion is clamped by the slide press attachment 40, the pallet 1 is decelerated according to a change in posture of the slide press attachment 40, and the slide roller 44 is separated at the thrust connection point between the deceleration portion and the second low-speed portion, thereby decelerating the moving speed of the pallet 1 from the high speed of the high-speed portion to the low speed of the second low-speed portion.

The structure and the operation of the deceleration chain driving device 15*b* are the same as those of the deceleration chain driving device 15*a*.

Figure 10:
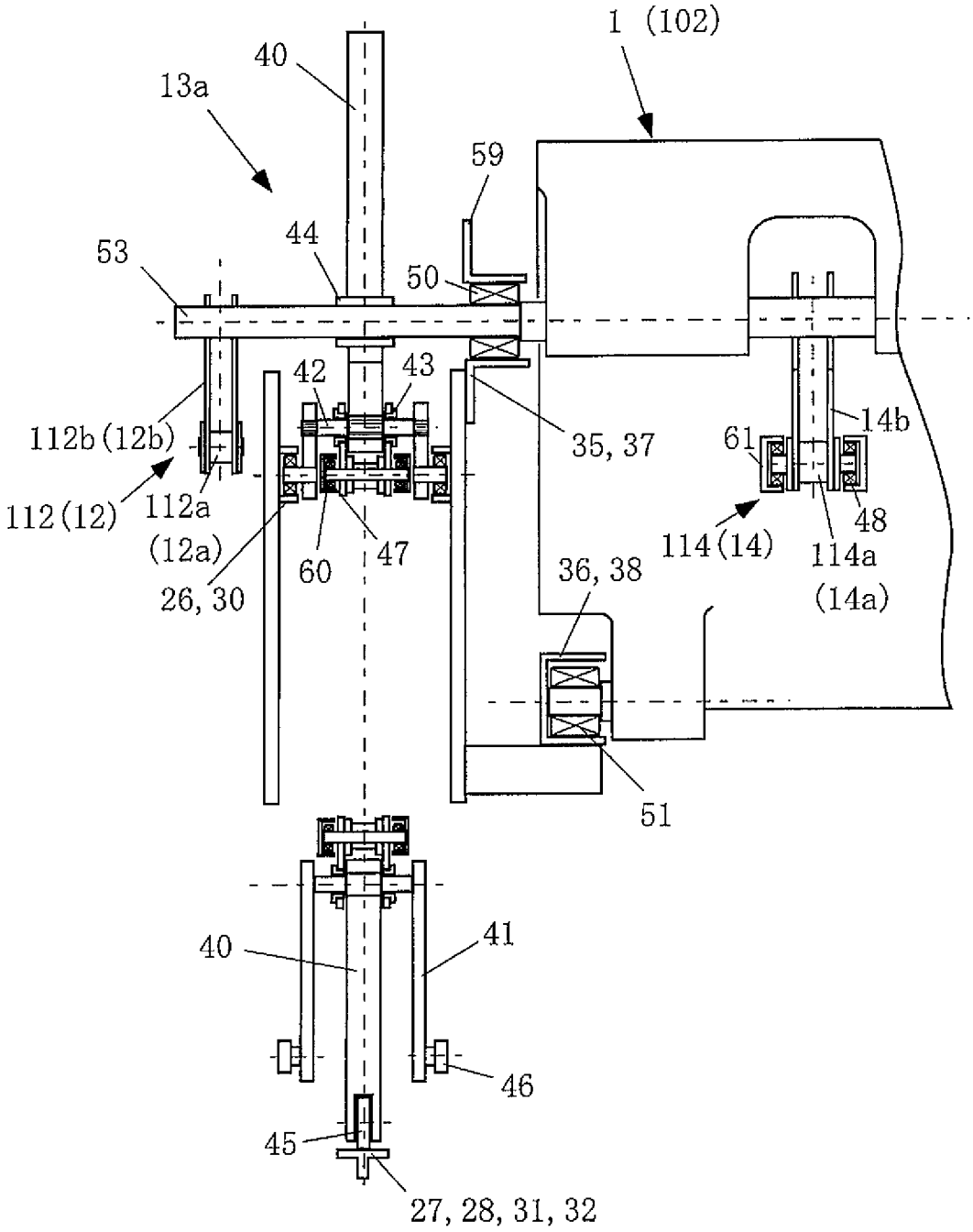
FIG. 10 is a partially cross-sectional view illustrating the acceleration and deceleration device and the driving device of the acceleration and deceleration escalator of the invention.
Figure 11:
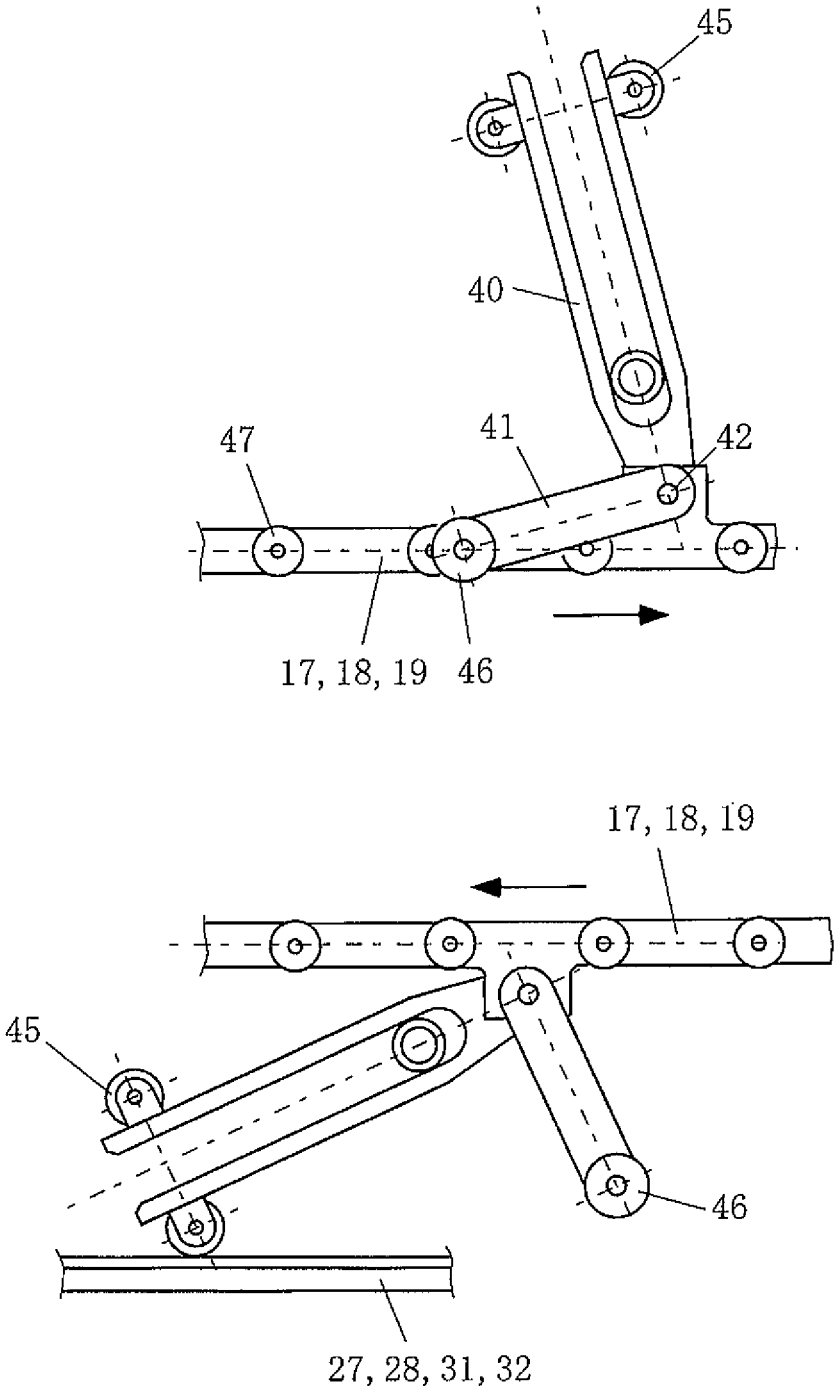
FIG. 11 is a left view of FIG. 10.
Figure 12:
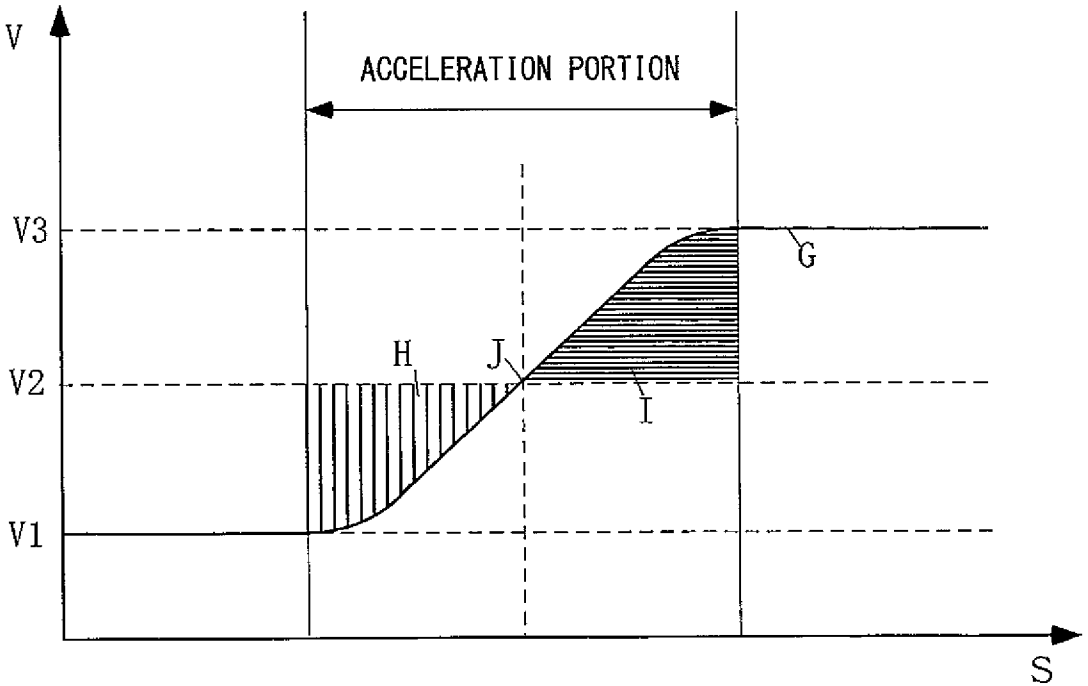
FIG. 12 is a diagram illustrating the deceleration/acceleration movement of a slide press attachment in an acceleration and deceleration portion of an ascending acceleration and deceleration escalator.

FIG. 10 is a partially cross-sectional view illustrating the acceleration and deceleration device 100 and the driving devices 110 and 10 of the acceleration and deceleration escalator 101 of the invention, and FIG. 11 is a left view of FIG. 10. Furthermore, FIG. 12 is a diagram illustrating the deceleration/acceleration movement of the slide press attachment 40 at the acceleration and deceleration portion of the ascending acceleration and deceleration escalator. The curve G indicates a change in speed of the pallet 1 (the subject moving body 102), and V2 indicates the chain speed of the acceleration and deceleration device 100. The horizontal axis indicates a distance, and the vertical axis indicates a speed.

In FIG. 10, the travel support roller 50 is positioned between the travel support roller guiding rails 35 and 37 and the lift preventing rail 59, and hence is not deviated from the travel support roller guiding rails 35 and 37.

Furthermore, each of the posture roller guiding rails 36 and 38 is a member which has a U-shaped cross-section, and the posture roller 51 is positioned between the upper and lower members, so that the posture roller 51 is not deviated from the posture roller guiding rails 36 and 38.

The drive attachment 114*b* of the high-speed chain driving device 114 of the first embodiment or the drive attachment 14*b* of the high-speed chain driving device 14 of the second embodiment is fitted to the lower portion of the footplate 1*a* and the pallet driving shaft 53 of the pallet 1, and drives the plural pallet 1 at the same high speed with the same slope. Furthermore, in the chain bodies 114*a* and 14*a*, the chain traveling roller 48 is guided along the chain traveling rail 61 so as to travel in a linear shape.

Furthermore, the drive attachment 112*b* of the low-speed chain driving device 112 of the first embodiment or the drive attachments 12*b* and 16*b* of the low-speed chain driving devices 12 and 16 of the second embodiment is fitted to the front end portion of the pallet driving shaft 53, thereby driving the plural pallets 1 at the same low speed.

In FIG. 10, the acceleration and deceleration device 100 is positioned between the low-speed chain driving devices 112, 12, and 16 and the traveling roller 50 of the pallet 1.

In FIG. 11, the acceleration and deceleration device 100 includes: chains 17, 18, and 19 which have the chain traveling roller 47 at the connection portion and endlessly rotate; the slide press attachment 40 which is attached to the chain 17, 18, 19 at the same pitch P2, and the swing yoke 41 which is provided so as to be perpendicular to the slide press attachment 40.

As shown in FIG. 10, the chain traveling roller 47 is guided along a predetermined track by the acceleration and deceleration chain traveling rail 60. Furthermore, the slide press attachment 40 and the swing yoke 41 are mechanically connected to each other through the connection shaft 42, and are configured to swing about the connection shaft 42 by the bearing 43. The fitting portion of the connection shaft 42 is strongly fitted so as not be loosened.

In FIG. 11, the slide press attachment 40 is a U-shaped member of which a terminal end portion is attached to the chain so as to be swingable and a part from the intermediate portion to the front end portion is formed as two parallel members and which has a long and narrow U-shaped groove between the parallel members. Furthermore, the skip roller 46 is provided at the front end portion of the swing yoke 41.

As shown in FIG. 10, the slide press attachment 40 clamps the slide roller 44 provided in the pallet driving shaft 53 of the pallet 1 between the U-shaped member, and drives the pallet 1. It is desirable that the slide roller 44 is a bearing, an oilless bushing, a resinous ring, or the like.

Furthermore, the skip roller 46 is guided along a predetermined track by the skip rail 25 in the first embodiment and the skip rails 26 and 30 in the second embodiment. Then, due to the relationship of the distance and the position between the skip rails 25, 26, and 30 and the chains 17, 18, and 19, the slide roller 44 of the pallet 1 approaching at the lower speed than that of the upstream side is reliably fitted into the U-shaped groove of the slide press attachment 40 at the "thrust connection point".

Furthermore, the acceleration and deceleration device 100 needs to be smoothly accelerated and decelerated while a difference in speed between the chain speed V1 of the low-speed portion and the chain speed V3 of the high-speed portion and the chain speed V2 of the acceleration and deceleration device 100 are maintained to be constant. The acceleration and the deceleration of the smooth movement are adjusted by the movement of the slide press attachment 40.

That is, as shown in FIG. 12, in the case of the acceleration and deceleration device 100 of the acceleration portion of the ascending escalator, the slide press attachment 40 is inclined in the direction opposite to the advancing direction (the deceleration operation range H) and the speed of the pallet 1 is gradually increased from V1 to V2 until the speed of the pallet 1 becomes equal to the chain speed V2. Then, at the downstream (the acceleration operation range I) from the point (J-point) where the difference between the speed of the pallet 1 and the chain speed V2 becomes 0, the slide press attachment 40 is inclined in the same direction as the advancing direction of the pallet 1 and the speed thereof is accelerated to V3.

Furthermore, although the function of the acceleration and deceleration device is reversely switched to the deceleration device during the reversing operation, the deceleration operation is the same as that of the description above.

Furthermore, with regard to the thrust generating mechanism of the pallet 1 of the slide press attachment 40, in the first embodiment, the moment generated when the acceleration and deceleration device 100 travels and the skip roller 46 of the swing yoke 41 travels along the skip rail 25 is used. On the contrary, herein, the moment generated when the chain traveling roller 47 of the acceleration and deceleration device 100 travels inside the rail 60 at a position different from the skip rail 25 is used.

With regard to the thrust angle at which the slide press attachment 40 comes into contact with the slide roller 44, the pitch P2 is determined and the effective thrust is ensured by disposing each slide press attachment 40 so as to be perpendicular to the advancing direction as much as possible.

Accordingly, the attachment pitch P2 of the slide press attachment 40 attached to the acceleration and deceleration device 100 is set to be longer than the attachment pitch P1 of the pallet 1 of the initial speed region and the final speed region, and is set to be shorter than the pitch P3 of the pallet 1 of the high-speed portion.

This is because the acceleration and deceleration and the stroke are not obtained within the set acceleration and deceleration distance when the pitch of the slide press attachment s 40 is the same as the pitch of the pallets 1 with respect to the required acceleration and deceleration distance. At the same time, this is because the inclination angle of the swing yoke 41 with respect to the advancing direction of the acceleration and deceleration device 100 may be set to be small and a series of slide press attachments 40 may be smoothly traveled.

Furthermore, in FIG. 10, the acceleration chain driving device 13*a* of the second embodiment is positioned between the low-speed chain driving device 12 and the travel support roller 50 of the pallet 1. Then, the guide roller 45 is provided at both outsides of the front end portion of the U-shaped member, and the guide roller 45 is guided along a predetermined track by the connection guide assisting rails 27, 28, 31, and 32 in the returning line of the chain.

Furthermore, in the acceleration and deceleration device of the first embodiment, there is no need to be equipped with the guide roller 45 and the connection guide assisting rails 27, 28, 31, and 32.

In FIGS. 10 and 11, in order that the slide roller 44 of the pallet 1 advancing at the lower speed than that of the upstream side is reliably fitted into the U-shaped groove of the slide press attachment 40, the guide roller 45 of the slide press attachment 40 guides the U-shaped groove opening of the slide press attachment 40 along the connection guide assisting rails 27, 28, 31, and 32 to the "thrust connection point".

Furthermore, with regard to the thrust generating mechanism of the pallet 1 of the slide press attachment 40, in the second embodiment, the moment generated when the chain driving devices 13*a* and 13*b*, 15*a*, 15*b* travel and the skip roller 46 of the swing yoke 41 travels along the skip rails 26 and 30 is used. On the contrary, herein, the moment generated when the chain traveling rollers 47 of the chain driving devices 13*a*, 13*b*, 15*a*, and 15*b* travel inside the rail 60 at a position different from the skip rails 26 and 30 is used.

Furthermore, the method of changing the angle of the U-shaped member with respect to the subject moving body 102 is not limited to the method of the embodiment. That is, the angle of the U-shaped member may be changed through the rotation of an actuator by attaching the actuator between the U-shaped member and the chain. Furthermore, the other methods may be adopted.

Furthermore, the method of changing the position of the driving shaft inside the U-shaped groove of the U-shaped member is not limited to the method of the embodiment. An actuator may be provided in the base of the U-shaped groove of each U-shaped member so as to move the driving shaft up and down. Furthermore, the other methods may be adopted.

Furthermore, in the acceleration and deceleration escalator of the embodiment, the trajectory which is drawn by the travel support roller guiding rail and the first and second tracks are set as described in FIG. 1, 8, or 9. However, these tracks may be, of course, changed into a linear shape or a horizontal curved shape depending on the use purpose of the acceleration and deceleration device 100.

Furthermore, in addition, when the acceleration and deceleration devices are arranged in series, the acceleration and deceleration devices may be further accelerated or decelerated and the acceleration and deceleration length may be further reliably obtained from the operation principle thereof, so that the acceleration and deceleration devices may be fit for the application field.

Figure 13:
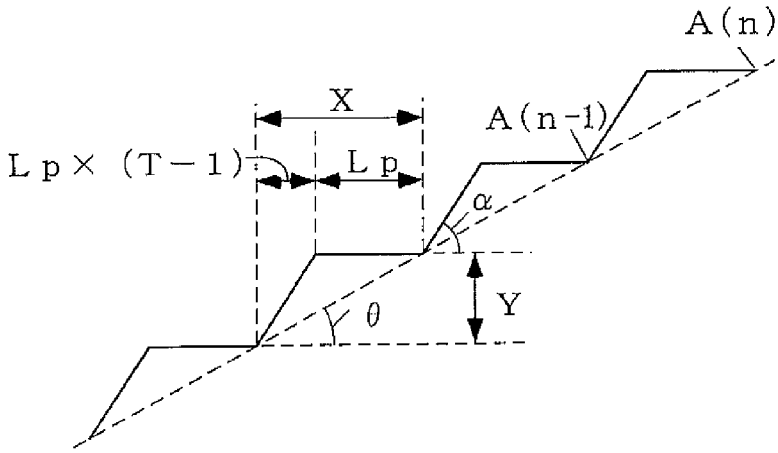
FIG. 13 is a diagram illustrating a dimensional relationship between the pallets in the high-speed portion.

FIG. 13 is a diagram illustrating a dimensional relationship between the pallets in the high-speed portion.

Furthermore, the angle α is expressed in Equation (2).

$$\alpha=\tan^{-1}\{Y/(Lp\times(T-1)\} \quad (2)$$

Furthermore, n indicates the number of steps of the pallet step Lp at the high-speed portion.

In the introduction length Lp of the pallet, when the horizontal speed of the high-speed portion increases T times the horizontal initial speed V1 of the entrance, the horizontal speed V3 in the high-speed portion is expressed by Equation (3).

$$V3=V1\times T \quad (3)$$

When a change in speed is substituted by the distance X between the pallets, the distance X between the pallets is expressed by Equation (4).

$$X=Lp\times V3/V1 \quad (4)$$

Furthermore, when the inclination angle of the inclined plate 1*b* is set to □, the vertical height Y of the pallet is expressed by Equation (5).

$$Y=\{Lp\times(T-1)\}\times\tan\alpha \quad (5)$$

Furthermore, even in the inclination angle θ of the escalator, generally, the height becomes T times the pallet pitch of the escalator.

Next, the method of setting the acceleration and deceleration speed and the acceleration and deceleration region of the acceleration and deceleration device 100 will be described.

Figure 14A:
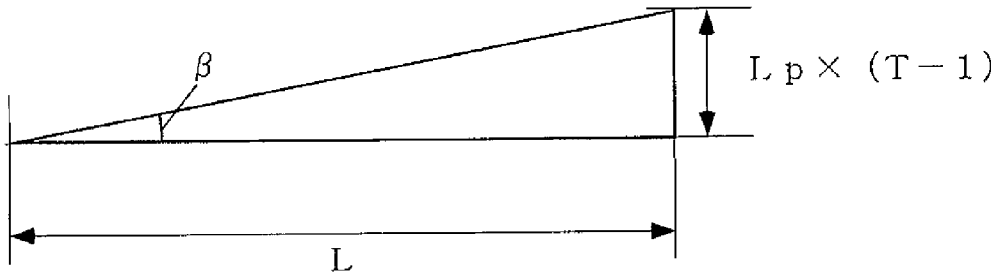
FIG. 14A is a diagram illustrating the acceleration and deceleration speed of the acceleration and deceleration device with respect to an acceleration angle □.
Figure 14B:
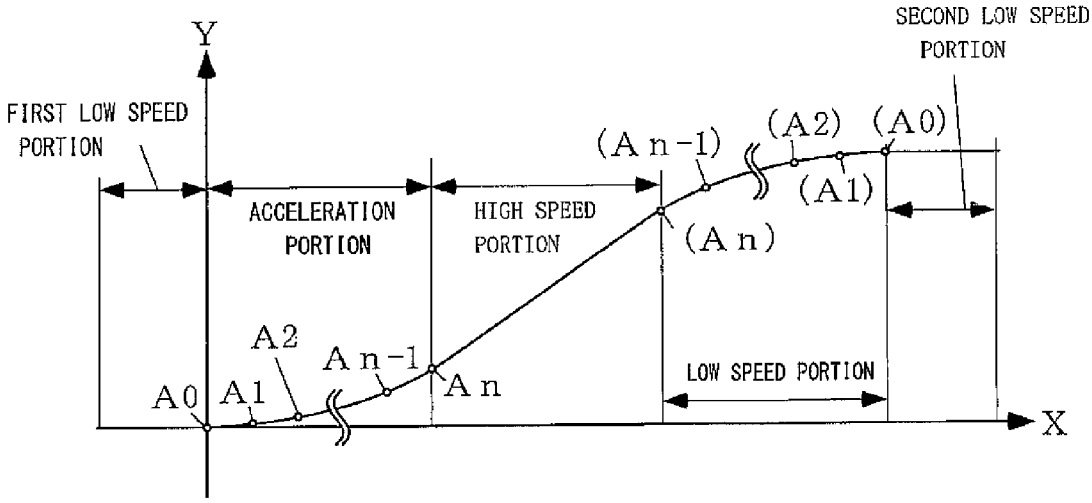
FIG. 14B is a diagram illustrating the XY coordinates of the contact point A between the front end of the pallet 1 and the adjacent pallet.

FIG. 14A is a diagram illustrating the acceleration angle β of the acceleration and deceleration speed of the acceleration and deceleration device 100. FIG. 14B is a diagram illustrating the XY coordinates representing the contact point A between the front end of the pallet 1 and the adjacent pallet.

First, the multiple times speed T of the pallet, the length L of the acceleration and deceleration region, and the introduction length Lp of the pallet are set.

In the horizontal direction of the escalator, the extension margin between the pallets in the acceleration and deceleration region L becomes maximum Lp×(T−1).

Furthermore, the acceleration angle β is obtained as Equation (6).

$$\text{acceleration angle } \beta=\tan^{-1}\{Lp\times(T-1)\}/L \quad (6)$$

Furthermore, when the coordinates of the contact points "A1, A2, A3, . . . An" between the front end of the pallet 1 and the adjacent pallets 1 in the X and Y axes are obtained from the start point A0 of the horizontal portion in the acceleration portion to the contact point An between the acceleration portion and the high-speed portion on the basis of FIGS. 13, 14A, and 14B, the coordinates are calculated in Equation (7).

[Expression 1]

$$A0\begin{cases} AX0 = 0 \\ AY0 = 0 \end{cases} \quad (7)$$

$$A1\begin{cases} AX1 = Lp + Lp \times \tan\beta \\ AY1 = Lp \times \tan\beta \times \tan\alpha \end{cases}$$

$$A2\begin{cases} AX2 = (AX1 + Lp) \times (\tan\beta + 1) \\ AY2 = AY1 + (AX1 + Lp) \times \tan\beta \times \tan\alpha \end{cases}$$

$$A3\begin{cases} AX3 = (AX2 + Lp) \times (\tan\beta + 1) \\ AY3 = AY2 + (AX2 + Lp)\tan\beta \times \tan\alpha \end{cases}$$

$$\vdots$$

$$An\begin{cases} AXn = (AX(n-1) + Lp) \times (\tan\beta + 1) \\ AYn = AY(n-1) + (AX(n-1) + Lp)\tan\beta \times \tan\alpha \end{cases}$$

The desired acceleration and deceleration speed and the acceleration and deceleration region length may be attained by setting the start points (A1, A2, A3, . . . An) of the respective pallets 1 based on Equation (7). That is, these start points correspond to the positions of the slide rollers 44 of the pallets 1, and the slide roller may be clamped by the U-shaped member of the slide press attachment, so that the analogue movement amount and the thrust may be applied to the pallet 1.

As described above, the invention creates a synergy effect by the combinations of the different chain speeds, the different attachment pitches, and the press attachment performing both swinging and sliding movements. The invention modifies the structure of the pallet 1 and drastically decreases the speed at the entrance. The invention further increases the speed of the traveling portion, shortens the traveling time, and further ensures the safety.

In the description above, the case of the ascending escalator has been described, but the rotation direction may be the normal direction and the reverse direction, and the escalator may be applied to the descending purpose by reversing the rotation direction.

As described above, in the invention, since the subject moving bodies 102 are all driven through the chain, the durability improves, the structure is simplified, the weight is decreased, the maintenance cost is reduced, and the initial cost is reduced.

Furthermore, the acceleration and deceleration device 100 of the invention may be made to be compact so as to be included in the feet width of the existing escalator. Further, the inclination angle, the acceleration and deceleration, and the acceleration and deceleration length may be freely set.

Furthermore, in the invention, the pallet 1 is basically integrally molded, and is configured to be expanded and contracted during the speed varying operation including acceleration in a manner such that a part hidden at the bottom protrudes as an upper surface.

Each pallet is a "single unit component", and is not an integrated type in which all pallets are assembled to the driving chain as in the related art.

Furthermore, in any portion, the pallets are individually connected to several chains, and are clamped inside the traveling rail, thereby preventing the pallet 1 from being deviated from the chain.

The above-described device of the invention has the following characteristics.

(1) A simple structure is adopted in which a general chain is used to generate power.

(2) Since the chain tensile force is effectively used as a driving force, the durability of the device is high.

(3) The device is a unique mechanism in which the chain pitch is determined according to the arrangement capable of maintaining the "effective inclination angle" of the press attachment emphasizing the entire connection as best as possible, the chain speed in the acceleration and deceleration portion is set to the variable speed, and a part of the press attachment travels inside the skip rail different from the traveling path of the chain, so that a change in acceleration and deceleration is freely occurs.

(4) The structure is simple and a decrease in maintenance cost and a decrease in weight may be expected.

(5) The thrust may be maintained while smoothly following the positional change amount of the pallet since the pitch P2 of the chain of the acceleration and deceleration region is wider than the pitch P1 of the pallet of the horizontal portion.

(6) A change in length of the device may be handled by changing the chain of the high-speed portion.

(7) The acceleration portion and the deceleration portion may individually change the acceleration and deceleration speed.

As described above, according to the configuration of the invention, since the chain is mainly used without using a curved link, the respective components may be used in a basically reasonable structure, the structure is simple, the number of components is few, and the practicality is high. For this reason, the durability is high, the maintenance cost may be reduced, and the weight may be decreased.

Further, since the subject moving body 102 is accelerated or decelerated according to a change in track or a change in position of the chain or the rail, a strong driving force may be obtained from the analogue acceleration or deceleration.

Furthermore, the acceleration and deceleration device 100 of the invention has been described in conditions that the subject moving body 102 is the pallet 1 and the acceleration and deceleration escalator is an embodiment, but the invention is not limited thereto. That is, the acceleration and deceleration device 100 of the invention may be used in any device in which the subject moving body 102 is accelerated and decelerated.

Furthermore, the invention is not limited to the above-described embodiments and may be, of course, modified into various forms without departing from the spirit of the invention.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the spirit and scope of the invention as defined in the appended claims.

What is claimed is:

1. An acceleration and deceleration device comprising:

a chain that is endlessly guided along a predetermined first track;

a U-shaped member of which a terminal end portion is attached to the chain so as to be swingable and a part from an intermediate portion to a front end portion is formed as two parallel members and which has a long and narrow U-shaped groove between the parallel members;

a subject moving body that has a driving shaft sliding inside the U-shaped groove of the U-shaped member; and a swing yoke that is provided so as to intersect with the U-shaped member;

a skip rail that guides the swing yoke along a predetermined second track; and a travel support roller guiding rail that guides the driving shaft along a predetermined track, wherein the driving shaft of the subject moving body is rotatable with respect to the U-shaped member within a predetermined range in the U-shaped groove of the U-shaped member, the driving shaft of the subject moving body is slidable with respect to the U-shaped member in the U-shaped groove of the U-shaped member, the first track and the second track are different so that a rotation angle of the U-shaped member can be changed when the U-shaped member is driven along the first track, and the first track and the second track are formed so that the driving shaft guided by the travel support roller guiding rail is driven to slide in the U-shaped groove when the U-shaped member is moved along the first track while changing the rotation angle.

2. An acceleration and deceleration escalator comprising:

the acceleration and deceleration device according to claim 1, wherein the subject moving body is a pallet for an escalator, the driving shaft is a pallet driving shaft, a slide roller provided in the pallet driving shaft is slidable in the U-shaped groove of the U-shaped member, and when the U-shaped member is driven along the chain, rotation angle of the U-shaped member is changed so that the slide roller is driven to slide in the U-shaped groove.

3. The acceleration and deceleration escalator according to claim 2, wherein the acceleration and deceleration device includes an acceleration chain driving device that accelerates the pallet of an acceleration portion from a first low speed to a high speed, and a deceleration chain driving device that decelerates the pallet of a deceleration portion from the high speed to a second low speed.

4. The acceleration and deceleration escalator according to claim 2, further comprising:

a plurality of the independent pallets that is continuously and endlessly arranged in a speed region which is sequentially divided into a first low-speed portion, an acceleration portion, a high-speed portion, a deceleration portion, and a second low-speed portion in the advancing direction from a lower step to an upper step;

a guiding device that guides the respective pallets according to an arrangement; and a driving device that drives the respective pallets at a low speed or a high speed, wherein the respective pallets are driven at a predetermined first low speed in the first low-speed portion, are driven at the high speed in the high-speed portion, and are driven at the second low speed in the second low-speed portion.

5. The acceleration and deceleration escalator according to claim 4, wherein each pallet includes a horizontal footplate on which a person gets and an inclined plate which obliquely extends downward from the rear edge of the footplate in the advancing direction, wherein each pallet includes the pallet driving shaft which is provided in the footplate and extends outward in a width direction, a travel support roller and the slide roller which are provided in the pallet driving shaft, and a posture roller which is provided in the inclined plate, wherein the guiding device includes a travel support roller guiding device which guides the travel support roller according to the arrangement, a posture roller guiding device which guides the posture roller so as to horizontally maintain the upper surface of the footplate, and a pallet reversing device which turns each pallet at both end portions thereof in the advancing direction so that the pallet is reversed, and wherein the driving device includes a first low-speed chain driving device which drives the pallet of the first low-speed portion at the first low speed, a high-speed chain driving device which drives the pallet of the high-speed portion at the high speed, and a second low-speed chain driving device which drives the pallet of the second low-speed portion at the second low speed.

6. The acceleration and deceleration escalator according to claim 3, further comprising:

a plurality of the independent pallets that is continuously and endlessly arranged in a speed region which is sequentially divided into a first low-speed portion, the acceleration portion, a high-speed portion, the deceleration portion, and a second low-speed portion in the advancing direction from a lower step to an upper step;

a guiding device that guides the respective pallets according to an arrangement; and a driving device that drives the respective pallets at a low speed or a high speed, wherein the respective pallets are driven at the predetermined first low speed in the first low-speed portion, are driven at the high speed in the high-speed portion, and are driven at the second low speed in the second low-speed portion.

* * * * *